US008944941B2

(12) United States Patent
Carlson et al.

(10) Patent No.: US 8,944,941 B2
(45) Date of Patent: Feb. 3, 2015

(54) INVERTIBLE SPORTS MOUND

(71) Applicant: Sports Complex Design Group LLC, Everett, WA (US)

(72) Inventors: James E. Carlson, Marysville, WA (US); Joseph G. C. Adams, Jr., Wenatchee, WA (US); Frederick J. Schmidt, Jr., Everett, WA (US)

(73) Assignee: Sports Complex Design Group LLC, Everett, WA (US)

( * ) Notice: Subject to any disclaimer, the term of this patent is extended or adjusted under 35 U.S.C. 154(b) by 0 days.

(21) Appl. No.: 13/998,997

(22) Filed: Dec. 30, 2013

(65) Prior Publication Data

US 2014/0187361 A1 Jul. 3, 2014

Related U.S. Application Data

(60) Provisional application No. 61/848,249, filed on Dec. 28, 2012.

(51) Int. Cl.

| | |
|---|---|
| ***A63B 71/00*** | (2006.01) |
| ***A63B 69/00*** | (2006.01) |
| ***A63C 19/02*** | (2006.01) |

(52) U.S. Cl.

CPC ..... *A63B 69/0002* (2013.01); *A63C 19/02* (2013.01); *A63B 69/0013* (2013.01); *A63C 2203/10* (2013.01)

USPC ..... 473/497; 473/499

(58) Field of Classification Search

CPC ..... A63B 69/0002; A63B 2069/0006; A63B 69/0013; A63C 19/12; A63C 19/04

USPC ..... 473/497, 499, 500, 501, 422

See application file for complete search history.

(56) References Cited

U.S. PATENT DOCUMENTS

| | | | | |
|---|---|---|---|---|
| 2,662,769 | A * | 12/1953 | Madsen | 473/497 |
| 2,947,540 | A * | 8/1960 | Henry | 473/499 |
| 3,862,756 | A * | 1/1975 | Selliken | 473/501 |
| 4,012,156 | A | 3/1977 | Turner et al. | |
| 4,591,154 | A * | 5/1986 | Santarone | 473/497 |
| 5,059,060 | A | 10/1991 | Steinhardt | |
| 5,769,745 | A * | 6/1998 | Bartoli | 473/497 |
| 5,919,103 | A * | 7/1999 | Bartoli | 473/497 |
| 6,767,296 | B1 * | 7/2004 | Johnson | 473/499 |
| 7,344,459 | B2 * | 3/2008 | Bykowsky | 473/497 |

(Continued)

FOREIGN PATENT DOCUMENTS

| | | | |
|---|---|---|---|
| DE | 40 40 589 A1 | 3/1990 | |
| EP | 1 728 926 A1 | 12/2006 | |
| WO | WO 2014/105098 A1 * | 7/2014 | A63B 69/00 |

*Primary Examiner* — Mitra Aryanpour

(74) *Attorney, Agent, or Firm* — Todd N. Hathaway

(57) ABSTRACT

An invertible mound assembly for a game field, to convert the game field between activities such as baseball that require a raised mound and other activities such as soccer or football that require a continuous flat field surface. An invertible mound body having a raised surface on one side and a flat surface on the other is supported on a base structure in a recess in the game field. When disposed downwardly the raised surface is received in the recess while the base structure supports the flat surface of the mound body level and flush with the surface of the game field. When inverted and placed back on the base structure, the flat surface of the mound body is disposed downwardly and the raised surface of the mound body is disposed upwardly to form a mound that projects above the level of the game field.

20 Claims, 30 Drawing Sheets

(56) References Cited

U.S. PATENT DOCUMENTS

| | | | | |
|---|---|---|---|---|
| 7,648,432 | B1 * | 1/2010 | Hall | 473/499 |
| 2002/0165034 | A1 | 11/2002 | Katayama | |
| 2004/0142776 | A1 * | 7/2004 | Johnson | 473/499 |
| 2006/0100042 | A1 * | 5/2006 | Bykowsky | 473/497 |
| 2008/0171621 | A1 * | 7/2008 | Jacobson | 473/499 |
| 2014/0187361 | A1 * | 7/2014 | Carlson et al. | 473/497 |

* cited by examiner

INVERTIBLE SPORTS MOUND

RELATED APPLICATIONS

This application claims the benefit of Provisional Patent Application Ser. No. 61/848,249 filed Dec. 28, 2012.

BACKGROUND a. Field of the Invention

The present invention relates generally to field facilities for sports and games, and more particularly, to a mound system for a game field having a mound structure that is invertible between a raised configuration and a flat configuration in which the structure is flush with the surrounding surface of the field.

b. Related Art

As is well known, many forms of sports and athletic games are played on open fields, commonly covered with natural or artificial turf. Such fields are commonly constructed and maintained by schools and parks, as well as by stadiums and other professional sports facilities. By their nature, such fields are necessarily quite large (e.g., 100+ yards/meters in length) and relatively expensive to construct and maintain. In addition, the lighting, bleachers/seating, restrooms, parking lots and other facilities associated with the field represent very significant investments. Thus even relatively simple sports/game fields involve significant capital and operating costs.

As is also well known, many types of sports and athletic games require that the surface of the field be flat and unobstructed, examples common in North America include football, soccer and la crosse. However, other sports/games employ mounds or other raised features, examples being baseball and softball; for example baseball fields require a pitcher's mound located centrally in the diamond, and frequently additional mounds in the bullpen/warm up areas.

Raised mounds are incompatible with use of a field in a sport that requires a flat, unobstructed surface, however, for the reasons explained above, providing dedicated fields for each sport means increasing capital and operating costs, to the point where this is simply not feasible for many entities, especially schools and parks departments where funds are frequently limited. Even for professional sports teams, the cost of providing separate, dedicated stadiums (e.g., for football and baseball) is so great as to be impracticable for all but the largest cities.

As a result, certain efforts have been made at providing temporary mound structures, for converting a flat field to baseball/softball use for example, however the results have been very much less than satisfactory. Typically, such temporary mounds have taken the form of portable, lump-shaped structures that are pulled or otherwise transported into place and set atop the turf or other surface of the field. Then, when it is time for the field to be used for football, soccer or another sport requiring a flat, unobstructed surface, the portable mounds are hauled back off and stored.

However, as noted, the foregoing approach has several drawbacks. To begin with, considerable labor is required to "manhandle" the temporary mound to and from their locations on the field, and it is particularly difficult to maneuver the mounds into the correct position and alignment after they have been dropped onto the surface of the field. Also, due to their inherent size, the portable mounds require very substantial storage space when not in use, or if they are left exposed they are both unsightly and subject to damage from weathering.

In addition to the drawbacks discussed in the preceding paragraph, temporary mounds present significant problems from a player standpoint. For example, even the best fields often have small undulations or other surface irregularities, or may be crowned somewhat, such that establishing a close conformance between the surface of the field and the underside of the temporary mound is problematic. As a result, stability of the mound may be compromised, and gaps or other discontinuities may form between the edges of the mound and the surface of the field. At a minimum, a raised edge or lip will usually exist about the perimeter, owing to the need to have some material thickness at the edge of the mound. The existence of such discontinuities, as opposed to the smooth transitions that normally exist at the perimeters of traditional, permanent mounds, can create significant problems when struck by a ball and can also present trip hazards. These problems typically only become worse with age, especially owing to the tendency for personnel to roll or drag the mounds on their edges when moving them to and from the field.

Still further, in addition to the foregoing disadvantages, portable, temporary mounds of the type described above are typically visual incongruent with the surrounding field, especially at the perimeter, and otherwise present an appearance that is less than satisfactory for certain venues, such as professional sports facilities.

Accordingly, there exists a need for an apparatus and method for allowing sports fields to be provided with raised mounds when desired, and to be returned to a flat, unobstructed surface for activities where the mounds are not needed, without the use of temporary, portable mounds that need to be transported onto and off of the field. Furthermore, there exists a need for such an apparatus and method that allows the mounds to be provided on the field in an efficient manner and without requiring excessive labor. Still further, there exists a need for such an apparatus and method that minimizes discontinuities between the mound or mounds and the surrounding surface of the field. Still further, there exists a need for such an apparatus and method that avoids raised edges about the perimeter of the mound structure. Still further, there exists a need for such an apparatus and method that provides a structure that is stable, durable and long lasting in service. Still further, there exists a need for such an apparatus and method in which the upper surface of the mound smoothly transitions to the surrounding field surface so as to avoid visual incongruities and present a superior appearance not unlike a traditional fixed mound.

SUMMARY OF THE INVENTION

The present invention addresses the problems cited above, and provides a mound assembly that is selectively convertible between a raised configuration and a flat, level configuration.

In a broad aspect, the invertible mound assembly comprises: (a) a mound section, comprising a body having a first side with a raised mound surface and a second side with a substantially flat field surface; and (b) a base section that is mountable in a game field and that supports the mound section in the game field with the raised mound surface or flat field surface thereof disposed upwardly on an alternating basis.

The flat field surface may comprise a surface material that corresponds to a surface material of the game field. The surface material may comprise an artificial turf material.

The base section may comprise a recess extending below the level of the game field that receives the raised mound surface of the mound section when the flat field surface thereof is disposed upwardly.

The mound section may comprise a generally flattened body having the raised mound surface and the flat field surface formed on opposite sides thereof. The base section may comprise means for supporting the body of the mound section so that circumferential edges of both the raised mound surface and the flat field surface lie substantially flush with the surface of the game field when disposed upwardly on the base section. The means for supporting the mound section with the edges of the raised mound surface and the flat field surface level with the surface of the playing field may comprise an edge support set a predetermined depth below the surface of the game field, that corresponds to a predetermined thickness of the mound about an edge of the raised mound surface and flat field surface on opposite sides of the body.

The mound section may further comprise a flattened edge about a perimeter of the raised mound surface that cooperates with the flat field surface on the opposite side to define a load bearing flange about the edge of the mound body that corresponds in thickness to the predetermined depth of the support portion of the base section. The load bearing flange on the mound body may comprise a load bearing flange that extends about a perimeter of the mound body, and the load bearing portion of the base section may comprise a load bearing surface that extends about a perimeter corresponding to the perimeter of the mound body. The perimeter of the load bearing surface on the base section may extend around a perimeter of the downwardly extending recess in the base section.

The body of the mound section may be manually raisable, invertible and lowerable by personnel associated with the game field. The body of the mound section may comprise a shell member that forms the raised mound surface, and a plate member that forms the flat field surface, the plate member being mounted to the mound member so that the flat field surface and raised mound surface face outwardly on the opposite sides of the mound body. The shell member may be formed of a comparatively thin, lightweight material such that a hollow interior is formed beneath the raised mound surface. The hollow interior may be filled with a load bearing material that provides support beneath the raised mound surface.

The support portion of the base section may support the body of the mound section so that when disposed downwardly the raised mound surface is spaced above a bottom of the recess in the base section so as to leave space in the recess for storage of gear or equipment, or for placement or installation of cabinets, chests or other containers. The support portion of the base section may comprise a support ring mounted about a perimeter of the recess. The base section may further comprise means for supporting the support ring on an underlying substrate. The means for supporting the support ring on an underlying substrate may comprise a base ring mounted in engagement with the substrate, and at least one structural support member extending upwardly from the base ring to the support ring. The at least one structural support may comprise a plurality of vertical post members mounted between the support ring and the base ring. The substrate may comprise a foundation constructed below the base ring.

The present invention also provides a method for selectively converting a game field between having a raised mound configuration and a flat field configuration.

These and other features and advantages of the present invention will be more fully understood from a reading of the following detailed description with reference to the accompanying drawings.

DETAILED DESCRIPTION

Figure 1:
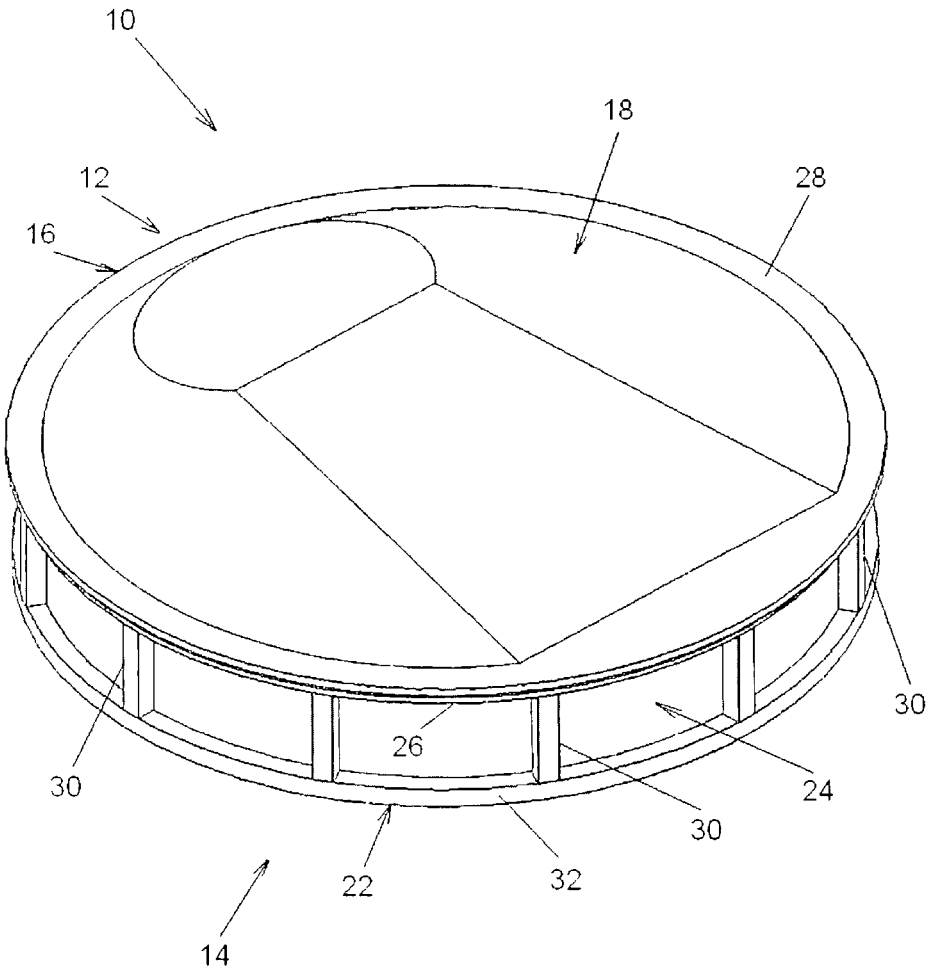
FIG. 1 is a top perspective view of an invertible mound assembly in accordance with a preferred embodiment of the present invention, showing the assembly with the mound section placed on the base section in the raised configuration.

FIG. 1 shows an invertible mound assembly 10 in accordance with a preferred embodiment of the present invention, for use with a game field, e.g., at a school, park, sports complex, stadium or other facility. It will be understood that the term "field" as used herein includes all such areas employed for sports, athletics and similar activities, regardless of the specific type of sport or activity or the particular nature of the facility.

As can be seen in FIG. 1, the invertible mound assembly 10 includes two major sections, mainly, a mound section 12 that is selectively invertible so as to have one of first and second, opposite sides disposed upwardly, and a base section 14 that supports the mound section and that defines a recess below the surrounding surface of the field.

Figure 2:
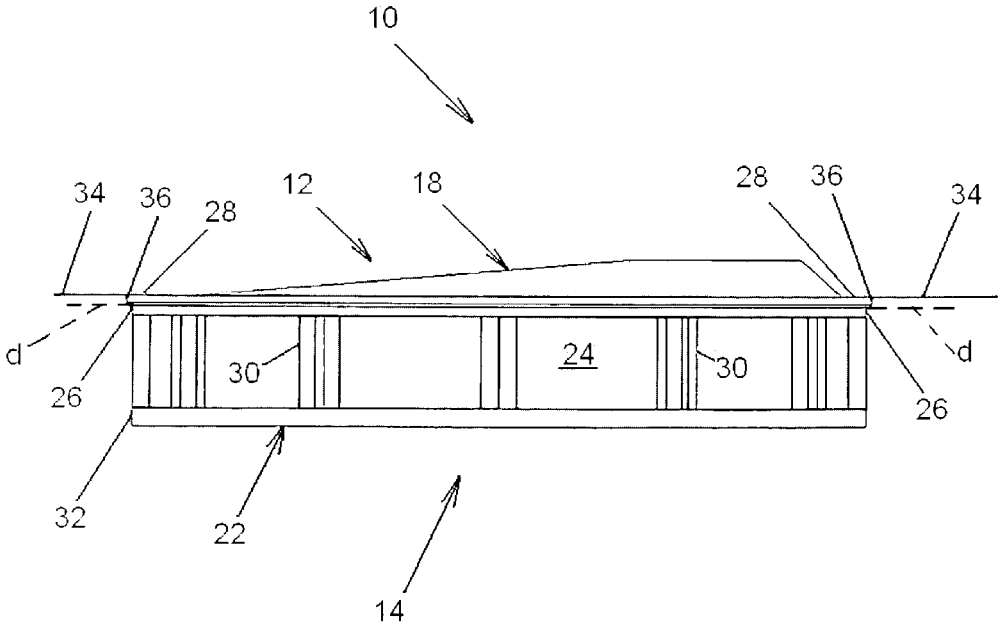
FIG. 2 is a side elevational view of the invertible mound assembly of FIG. 1, showing the manner in which the edges of the mound section lie flush with the surrounding surface of sports or athletic fields and the raised mound portion thereof extends upwardly therefrom.

As can be seen with further reference to FIG. 1 and also with reference to FIG. 2, the mound section 12 of the assembly includes a broadly speaking disk-shaped body 16 having a somewhat domed first side 18 (also referred to from time-to-time herein as the domed side or upper side) and a substantially flat opposite, second side 20 (also referred to from time-to-time herein as the flat side or bottom side). In the preferred embodiment that is illustrated the body 16 of the dome section is substantially circular in plan view, with the base section being correspondingly shaped, however it will be understood that in other embodiments different shapes may be employed, such as square, rectangular, polygonal, oval, tapered and tear-drop, for example. It will further be understood that the terms "circumference," "annular," "ring" and the like as used herein include both circular and non-circular forms.

The base section 14, in turn, includes a frame 22 that supports the mound section from below, and that is configured to be sunk below the surface of the field. In the illustrated embodiment, the frame has a multi-part construction, however it will be understood that some embodiments may use other forms of construction, e.g., a unitary construction, a cast in place construction and so on.

Figure 3:
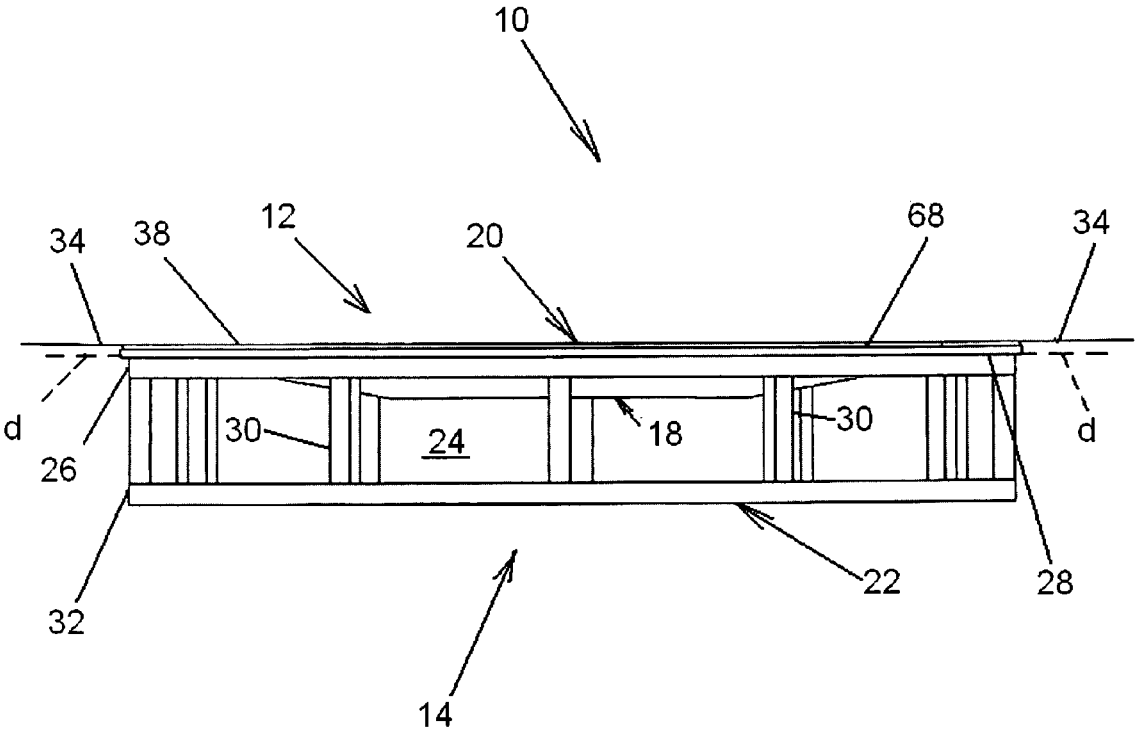
FIG. 3 is a side elevational view of the mound assembly of FIG. 1, similar to FIG. 2 but showing the mound section inverted and placed on the base section and the manner in which the reverse surface of the mound section extends flush with the surface of the surrounding field.
Figure 4:
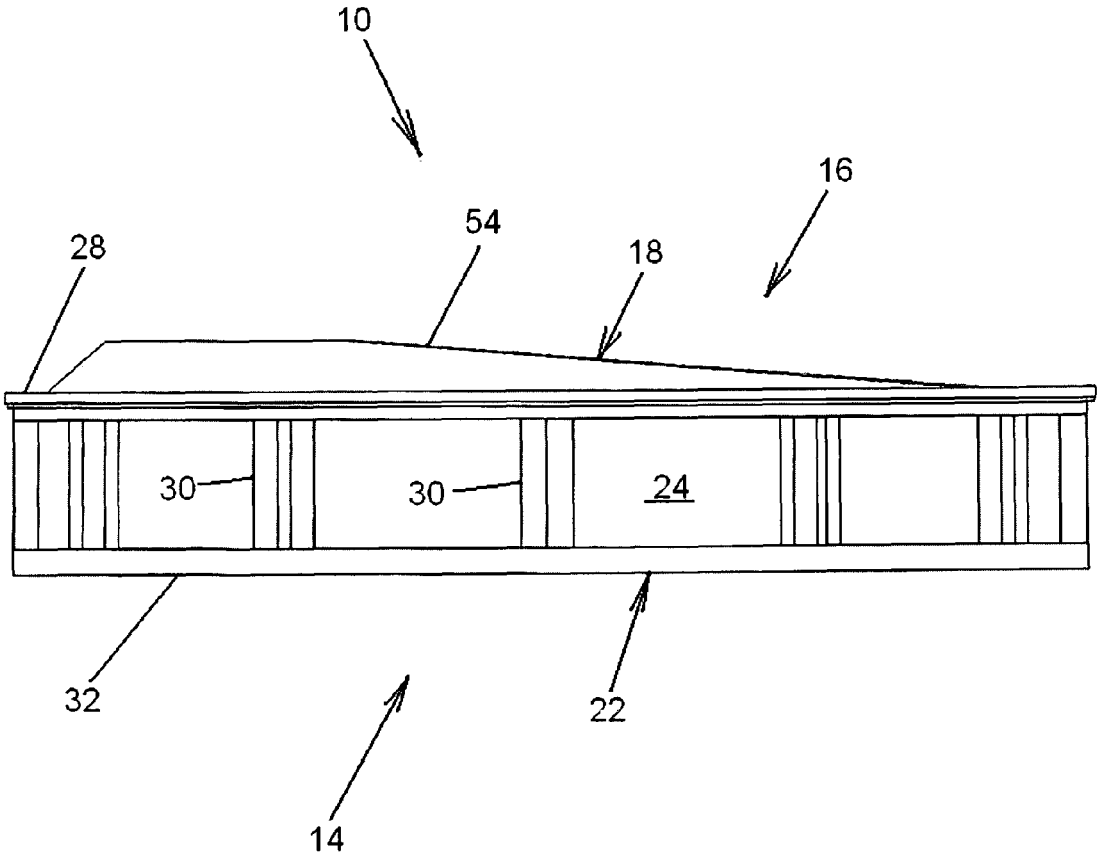
FIG. 4 is a second side elevational view of the mound assembly of FIG. 1, similar to FIG. 2, showing the structure of the mound and base sections in greater detail.

As can be seen with further reference to FIGS. 1-2, it can be seen that the base section frame 22 of the illustrated embodiment is constructed as a generally cylindrical framework defining a hollow interior 24, the latter being sized in diameter and height to receive the domed upper side 18 of the mound section when the latter is inverted, as shown in FIG. 3. The framework of the illustrated embodiment includes a ring member 26 having an upper side that forms an annular support surface 28 (see FIG. 8), configured to form a load bearing engagement with a correspondingly-shaped annular surface 28 formed about the perimeter of the body 16 of the mound section. The load bearing ring 26 is in turn supported on a plurality of columns or posts 30 at angularly spaced locations about the perimeter of the ring, that extend downwardly to a base ring 32, so that the upper ring is supported a spaced distance above the latter.

As can be seen in FIGS. 2-3, when installed the frame section 14 is set below the surface 34 of the field, so that the hollow interior 24 of the frame section forms a downwardly-extending recess. The lower ring 32 is mounted or set on an underlying foundation (not shown) that in some instances may include a drain for removing rain water. The foundation may be formed, for example, in an excavation formed in a field, or may be built up or otherwise constructed in the case of artificially supported, raised fields.

As can be seen with further reference to FIGS. 2-3, the upper ring 26 of the frame section is in turn recessed below the surface 34 of the field at a comparatively shallow depth "d" that is sized substantially equal to the thickness of the mound body 16 at the annular load bearing rim 28, the perimeter of the recess being configured to closely correspond to that of the mound body.

Thus, with the base section installed and the mound section placed thereon, as shown in FIG. 2, the circumferential edge of the mound body fits closely against the edge 36 of the opening in the field, while the upper surface of the annular rim 28 lies substantially level with the surface 34 of the field. As a result, discontinuities—both physical and visual—at the edge of the mound structure are effectively eliminated, with only the raised pitcher's mound 18 itself extending above the level of the field. Thus, in appearance and effect, the temporary mound provided by the present invention can be made effectively indistinguishable from a conventional, permanent mound.

When it is desired to return the field to a flat, unobstructed surface, for example for use as a football or soccer field, the mound section is raised and inverted, as will be described in greater detail below and set back on the base section with the flat surface 20 disposed upwardly as shown in FIG. 3. Since, as noted above, the thickness of the annular lip of the mound body is equal to the depth "d" of the load bearing surface of the upper ring 26 of the base section is sunk below the surface 34 of the field, the flat second surface 20 of the mound section lies level with the latter so as to be substantially coplanar with the surrounding surface of the field. Preferably, flat surface 20 is provided with a layer of artificial turf 38 or other covering that matches the material forming the surrounding surface 34 of the field, so that again there is effectively no visible or physical discontinuity created by the assembly. Additionally, artificial turf or other covering on the field itself can be drawn into the opening for the base section and fastened or otherwise attached at or below edge 36.

As can be seen with further reference to FIG. 3, when the mound section is in place with the flat side 20 disposed upwardly, the opposite side is received in the depression in which the base section is installed, the domed mound structure thereof depending from the annular lip 28 and extending downwardly into the hollow interior 24 of the frame 22. Although the height of the interior space 24 may in some instances be only deep enough to accommodate the height of the mound and no more (and in some cases the top of the mound itself may rest against and/or be supported by the bottom of the base section), the height of the interior can be somewhat greater as shown in FIG. 3, in order to form an equipment storage area below the mound surface 18.

Thus, from the perspectives of both players and viewers, the assembly integrates seamlessly with the surrounding field, whether in the raised, mound-up configuration or the flat, mound-down configuration. Moreover, this is achieved without need to transport mound pieces onto or off of the field, or to store such pieces when not in use. The edges of the mound structure are recessed so that they will not interfere with play, and regardless of configuration, they are protected against impact and damage; furthermore, because the rim is recessed below the surface of the field it need not be tapered to a fine edge and can be constructed with an edge thickness sufficient to provide superior durability and long service life.

Having provided an overview of the invention in its preferred embodiment, the mound and base sections in the manner in which they cooperate will now be described in greater detail with reference to FIGS. 4-10.

As was described above, and as can be seen in FIGS. 4-5, the body of the mound section 16 of the embodiment that is shown in the drawings has a somewhat disk-shaped form overall, although other embodiments may have non-circular forms in plan view.

The load bearing rim is preferably comparatively thin, in order to minimize weight and increase ease of handling, however it will be understood that the rim may have greater or lesser thicknesses depending on weight, material characteristics, and other design factors. Similarly, the load bearing rim 28 of the illustrated embodiment has a width corresponding generally to that of the load bearing surface on the upper ring of the base section, which again helps minimize bulk and weight of the mound section, however it will be understood that wider or narrower load bearing rims or flanges, or even partial rims or flanges, may be employed in some embodiments. Furthermore, in some instances the weight may be borne on other features or structures (e.g., one or more steps or posts within the recess) or even on the bottom of the recess itself, rather than by engagement of the rim and a load bearing ring on the base structure as in the illustrated embodiment.

Figure 5:
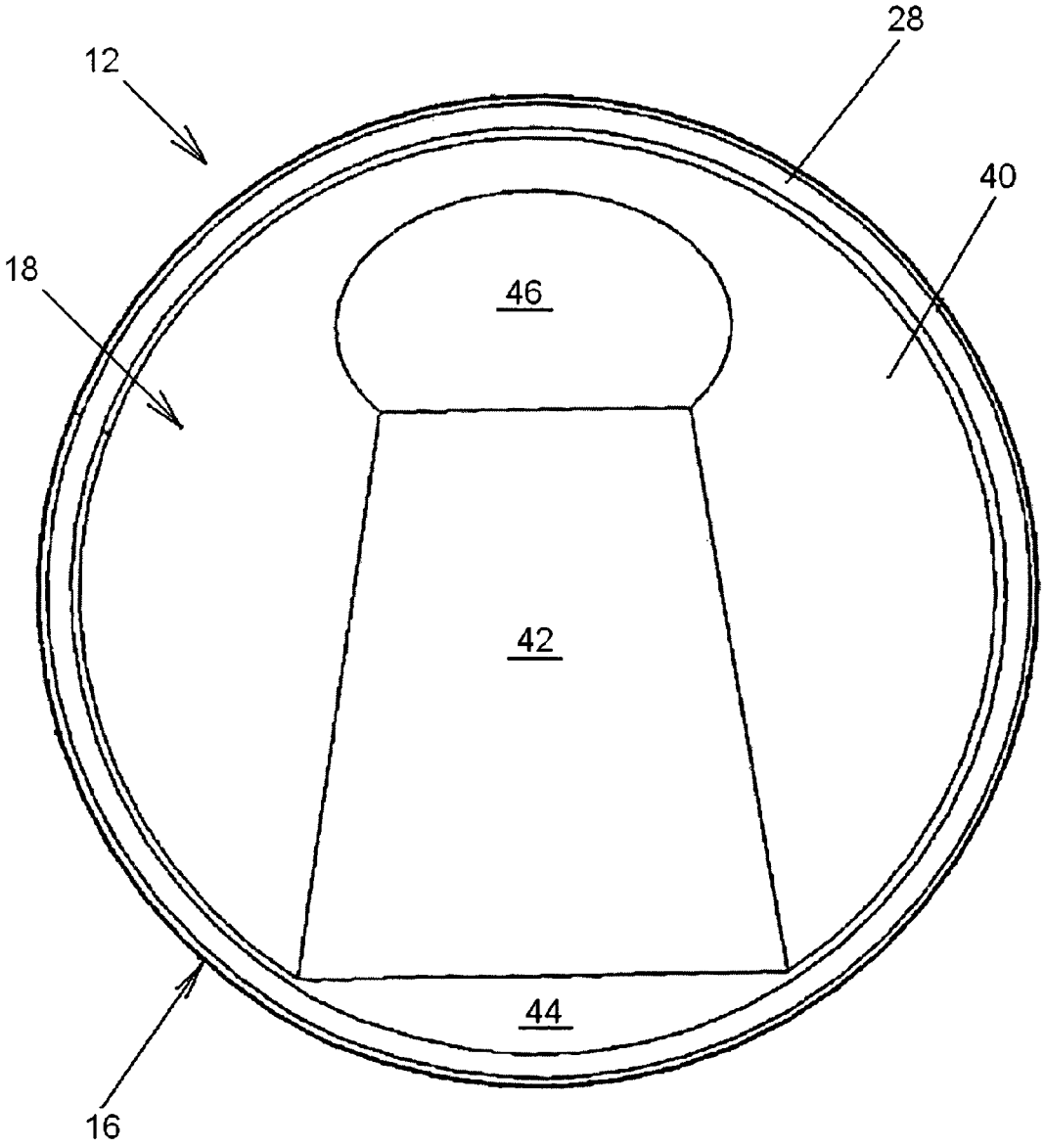
FIG. 5 is a top plan view of the mound section of the invertible mound assembly of FIGS. 1-4, showing the configuration of the first, raised surface of the mound section in greater detail.
Figure 6:
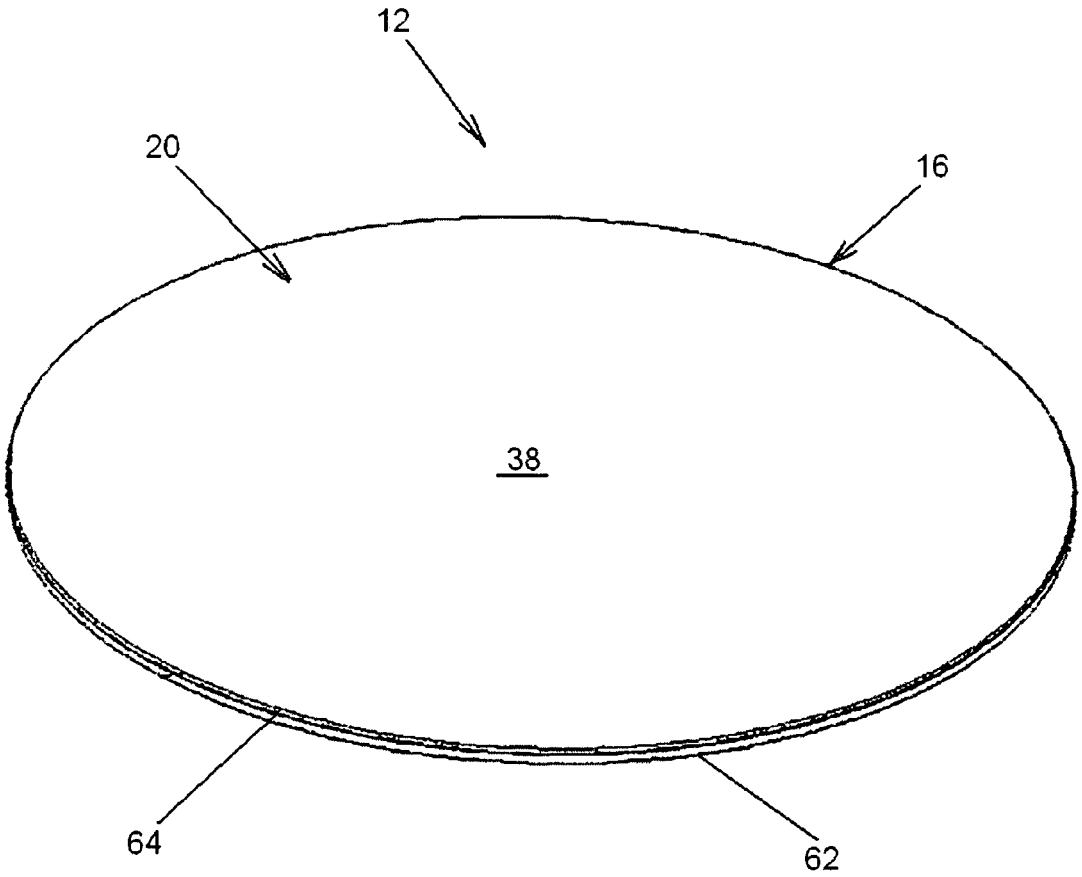
FIG. 6 is a bottom perspective view of the mound section of the invertible mound assembly of FIGS. 1-4, showing in greater detail the second, substantially flat surface on the second side of the mound section opposite the first side shown in FIG. 5.

As perhaps can best be seen in FIG. 5, the first, mound-shaped surface 18 of the illustrated embodiment includes a generally domed surface portion 40 that is circumscribed by the load bearing rim or flange 28. For baseball or softball use, the dome-shaped mound surface 40 is preferably sized in diameter, height and otherwise to have a configuration that satisfies the rules or regulations of the relevant organizing body, e.g., a diameter of approximately 10 feet and a rise of approximately 8-10 inches for Little League use. To this end, a ramp-shaped surface portion 42 extends upwardly from a flat, substantially field level surface area 44 at the rearward side of the mound structure (i.e., the side positioned away from the batter/home base) and terminates in an elevated, generally flat platform surface 46 located proximate the forward end of the mound structure, on which the pitcher can stand during use. The mound-shaped surface 18 may be provided with a covering of synthetic turf or other suitable material, or may be provided with a covering or other surface material colored or otherwise configured to resemble a traditional earthen mound. Furthermore, either or both of the ramp surface portion 42 and the platform surface portion 46 may be provided with a covering having enhanced traction and/or wear characteristics, to improve performance in conjunction with the pitchers' feet in these areas; these areas may also be provided with means allowing convenient replacement of the surface coverings, owing to the heavy traffic and/or cleat damage to which they are subjected, such as panels of turf, rubber, carpet or the like set within recesses in these areas and attached to the main dome structure by plugs, screws, hook-and-loop material or other suitable mechanisms.

Figure 7:
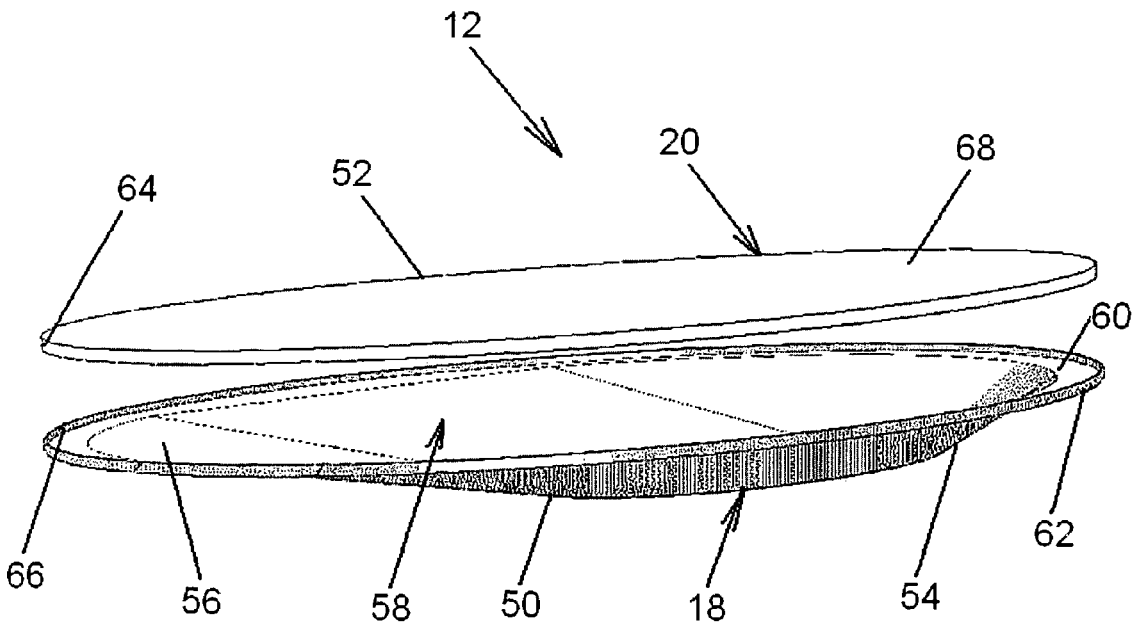
FIG. 7 is a bottom perspective, exploded view of the mound section of FIGS. 5-6 showing the construction of the mound section in greater detail.

As can be seen in FIG. 7, the body of the mound section 12 in the illustrated embodiment is constructed of a domed shell 50 and a flat base plate 52. The domed shell includes a generally convexly contoured exterior surface 54 that defines the domed side 18 of the mound section, the shell preferably being formed of a comparatively thin material such that the interior surface 56 of the shell is generally concavely contoured and defines an interior hollow 58, that is somewhat dish-shaped when the mound side of the shell is disposed downwardly as shown. The hollow is bordered by a generally flat flange portion 60, that defines the load bearing rim flange 28 of the mound section, and that is bordered about the outside by an upstanding (or depending when the mound side is disposed upwardly) rimmed wall 62. In the interest of maintaining low weight, the shell is preferably formed of a thin, rigid material having suitable strength and wear characteristics, such as molded plastic (e.g., PVC), stamped/formed aluminum or other metal, fiberglass or plywood, for example. In order to provide the domed mound surface with greater strength, the interior hollow 58 may be filled with a weight bearing material and/or structure (not shown) that transmits loads between the mound surface 54 and base member 52 such as closed or open celled foam material, aluminum/plastic honeycomb, or struts or vertical walls/ribbing, for example.

The base plate 52, in turn is formed as a flat, plate-like member, preferably of uniform thickness and having an outer edge 64 shaped and sized to nest within the inside surface 66 of the upstanding wall 62 about the perimeter of the domed shell 50, to which the plate member is adhered or otherwise mounted. The plate member may be formed of one or more pieces of sheet material having suitable strength, durability and weight characteristics, such as fiberglass sheet material, molded plastic material, carbon fiber or other fiber composite sheet material, synthetic or wood laminate sheet material, or aluminum or other metal sheet material, for example. The flat exterior surface 68 (i.e., the surface opposite that facing towards the interior 58 of the mound shell) thus provides a surface for mounting artificial turf or other material that forms the surface 38 corresponding to the adjoining surface 34 of the field (see FIG. 3) or in some embodiments the surface 68 may itself be provided with suitable texture and other characteristics and left exposed. Optionally, a molding with or without a resilient insert, similar to a boat hull edge "bumper," may be installed about the outside perimeter of the mound body to provide enhanced durability and/or a tighter fit against the opening in the field.

It will be understood that the generally two-piece construction described above, employing a relatively thin shell and base members and an interior filled by relatively lightweight load bearing material, has the advantage of providing a mound section that has hard, long wearing surfaces on both sides (i.e., both mound and flat sides) yet is light in weight and can therefore be raised and inverted with minimal effort. It will be understood, however, that other forms of construction may be used in some embodiments, including various forms of built-up construction or molded or cast construction, for example. Moreover, rather than a unitary body as shown, the mound body in some embodiments may be formed in two or more sections, e.g., for ease of shipping/transportation to the user facility.

Figure 8:
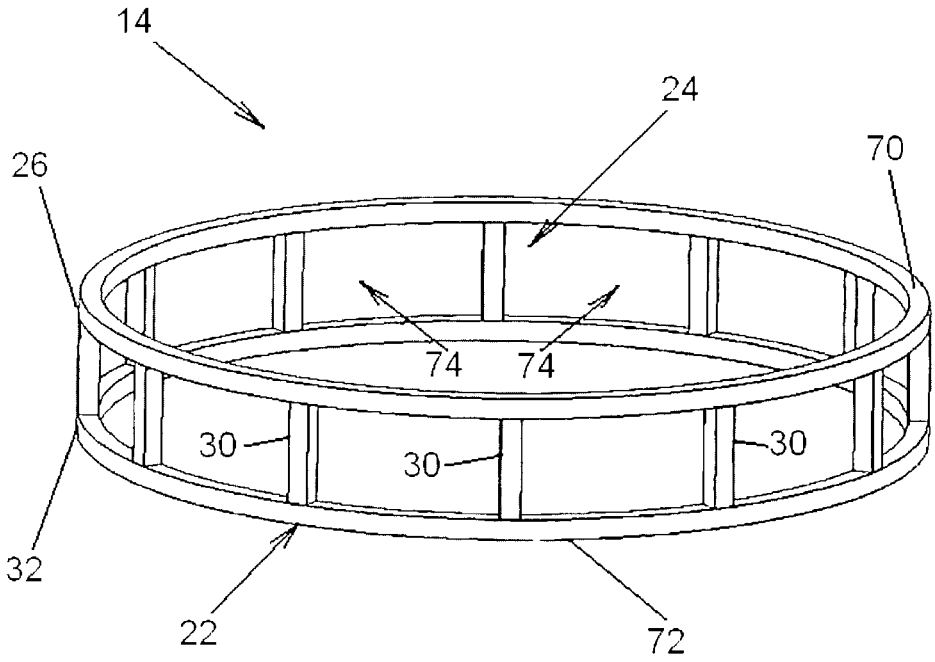
FIG. 8 is a top perspective view of the base section of the invertible mound assembly of FIGS. 1-4, showing the configuration of the base section in greater detail.
Figure 9:
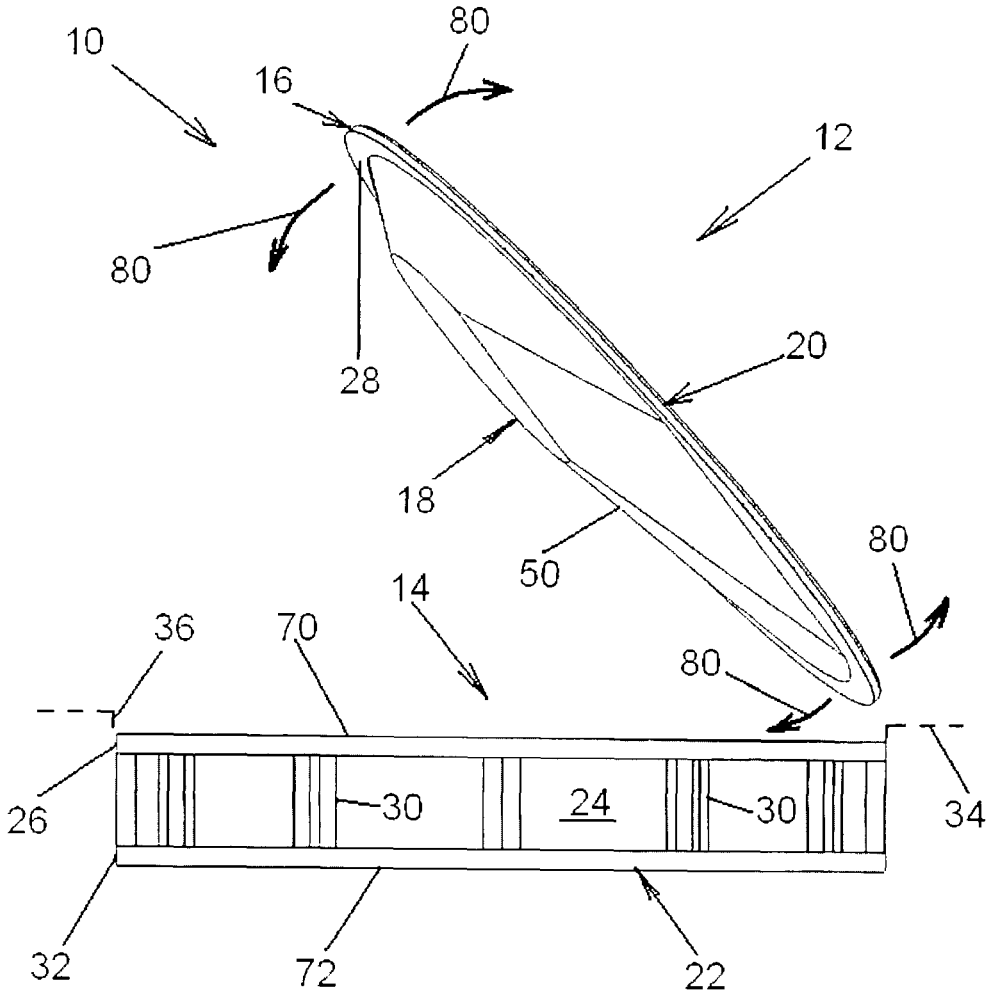
FIG. 9 is a side elevational view of the invertible mound assembly of FIGS. 1-4, with the mound section being shown in perspective for ease of understanding, showing the manner in which the mound section can be raised from the base section and flipped over to position the first, raised or second, flat side uppermost as desired.

FIG. 8, in turn, illustrates the structure of the base section 14 in greater detail.

As can be seen and as was described above, the base section of illustrated embodiment is constructed as a framework, with an upper load bearing ring 26 being supported a vertically spaced distance above a base ring 32 by a series of vertical posts or stanchions 30. Both rings are substantially rectangular in cross-section, with the upper ring having a substantially horizontal top surface 70 that forms a load bearing engagement with the cooperating flat load bearing rim of the mound section, and the lower ring 32 having a horizontal bottom surface 72 that rests on a cooperating surface of a foundation or other support. It will be understood that while the surfaces 70, 72 are flat, horizontal surfaces in the illustrated embodiment, in other embodiments they may be otherwise shaped depending on the surfaces with which they are designed to cooperate.

As was also described above, the upper and lower rings 26, 32 extend around the hollow interior 24 of the base section, the vertical spacing established by post 30 being sufficient that the interior opening is deep enough to accommodate the height of the convex mound surface when disposed downwardly on the base section. The substrate on which the lower ring 32 rests may be in the form of a foundation, that as described above may include a sump and drain for collection and removal of rain water; for example, drain lines may be installed at the bottom of the excavation, on top of which a pier pad may be placed that supports the bottom of the base section.

In order to keep interior 24 unobstructed, inwardly facing sides of the posts 30 preferably do not project significantly beyond the inside perimeter of the upper ring 26. The height may be sufficient that the interior of the base section can accommodate not only the downwardly extending domed surface of the mound section, but also equipment and gear stowed in the bottom of the recess and/or ice chests or other containers placed or installed in the recess. In addition, the gaps 74 between adjacent vertical posts 30 can provide access to additional storage areas external to the base section, e.g., beneath an artificially elevated field or in areas excavated beneath a conventional field, and cabinets for storage may be provided in these areas as well.

The base section 14 may suitably be constructed of metal tubing, such as square or rectangular cross-section aluminum tubing, for example; in this construction, the post may be cut from straight "sticks" of aluminum tubing and the upper and lower rings bent from the same material using conventional equipment, with the pieces then being welded or otherwise mounted together in a sturdy arrangement in which loads are transferred from the upper ring through the posts or to the lower ring, and from there to the foundation or other underlying support.

The form of construction described in the preceding paragraphs provides several advantages, notably low cost, high strength, good service life, and the ability to be assembled on-site if desired. It will be understood, however, that in some embodiments other forms of construction may be used: For example, rather than individual posts, a casing or shell, either full or partial, may be employed between the upper and lower rings. Similarly, rather than being "stick built" the base section may be constructed in fewer pieces or even have a monolithic construction, e.g., a poured in place concrete structure. Furthermore, certain embodiments may lack a lower ring, and simply transmit the loads into a foundation, the ground or other substrate using simply the vertical supports or a wall, or the upper ring or corresponding component may simply be set in direct load bearing engagement on the substrate and the recess formed therein to accommodate the height of the mound.

As has been described above, and as can be seen in FIG. 9, and as has been described above, the mound section of the assembly 10 is invertible between the "raised" and "flat" configurations by being lifted away from the base section and rotated or "flipped" in the desired direction, as indicated by arrows 80. The light weight achieved using the construction described above (e.g., approximately 250 pounds for a 10-foot diameter unit) allows this to be performed manually by a minimum number of personnel (such as two-person crews), thus minimizing costs.

Figure 10:
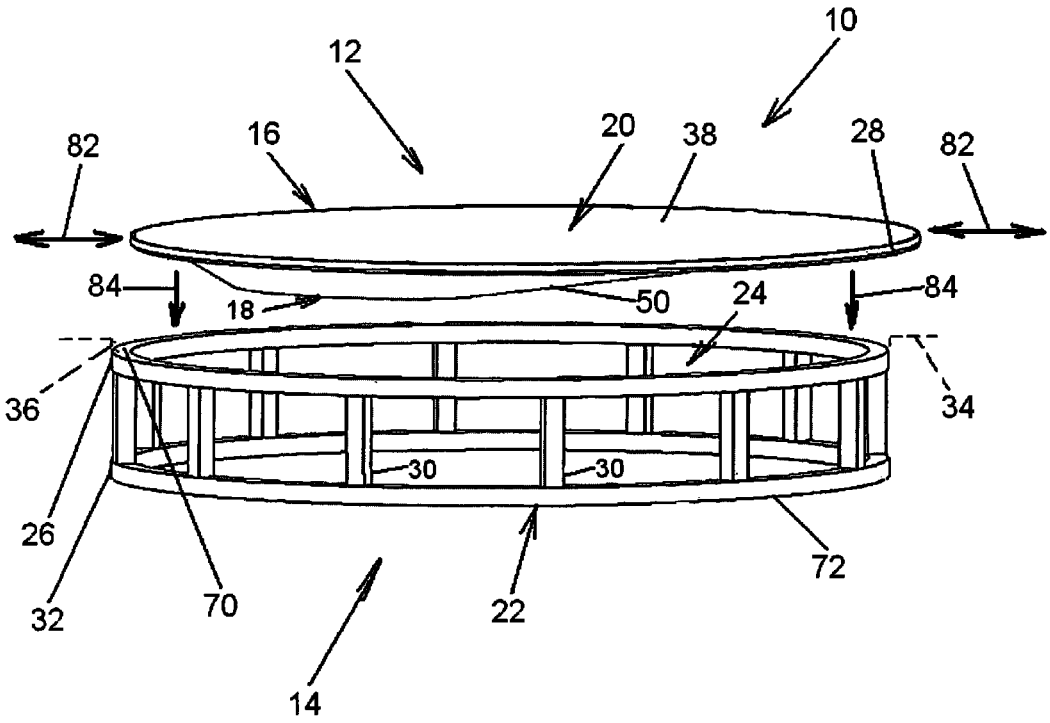
FIG. 10 is a top perspective view of the mound assembly of FIGS. 1-4, showing the manner in which the mound section is aligned with the opening of the mound section after being inverted as shown in FIG. 9, and then lowered therein so that the perimeter of the mound structure is supported on a cooperating ring of the base section.

Then, with the desired side facing upwardly, the mound section 12 is easily rotated and/or shifted laterally, as indicated by arrows 82 in FIG. 10, into the correct alignment relative to the base section 14 and also the playing field, after which the mound section can be lowered onto the frame section in the direction indicated by arrows 84 so that the lip flange 28 of the mound section rests in load bearing engagement with the cooperating surface 70 on the upper ring of the base section. Recessed hand-holds (not shown) or other grip structures may be provided to aid in raising/lowering and otherwise handling the mound section.

As opposed to the manual process described in the preceding paragraphs, it is envisioned that in some embodiments inversion of the mound section may be performed partially or entirely on a mechanical basis. For example, the body 16 of the mound section may be rotatingly supported on a cradle or axle that is raised and lowered by a jack, mechanical arm or similar device, with either or both of these mechanisms being manually operable or motorized, e.g., using electrical power lines that run beneath the surface of the field. Furthermore, it is envisioned that in some embodiments the axle or other rotational mechanism may be set more-or-less at field level, and retractable latches/locks or similar mechanisms may support the edge of the mound structure and hold it in place as opposed to a fixed support structure as in the ring 26 in the illustrated embodiment.

FIGS. 11-25 show a mound assembly 100 in accordance with another embodiment of the present invention. As will be described in greater detail below, mound assembly 100 is especially suited for installation in playing fields to permit alternate use in boys and girls baseball, although as with the embodiment described above it may be employed in a wide variety of other installations as well.

Figure 12:
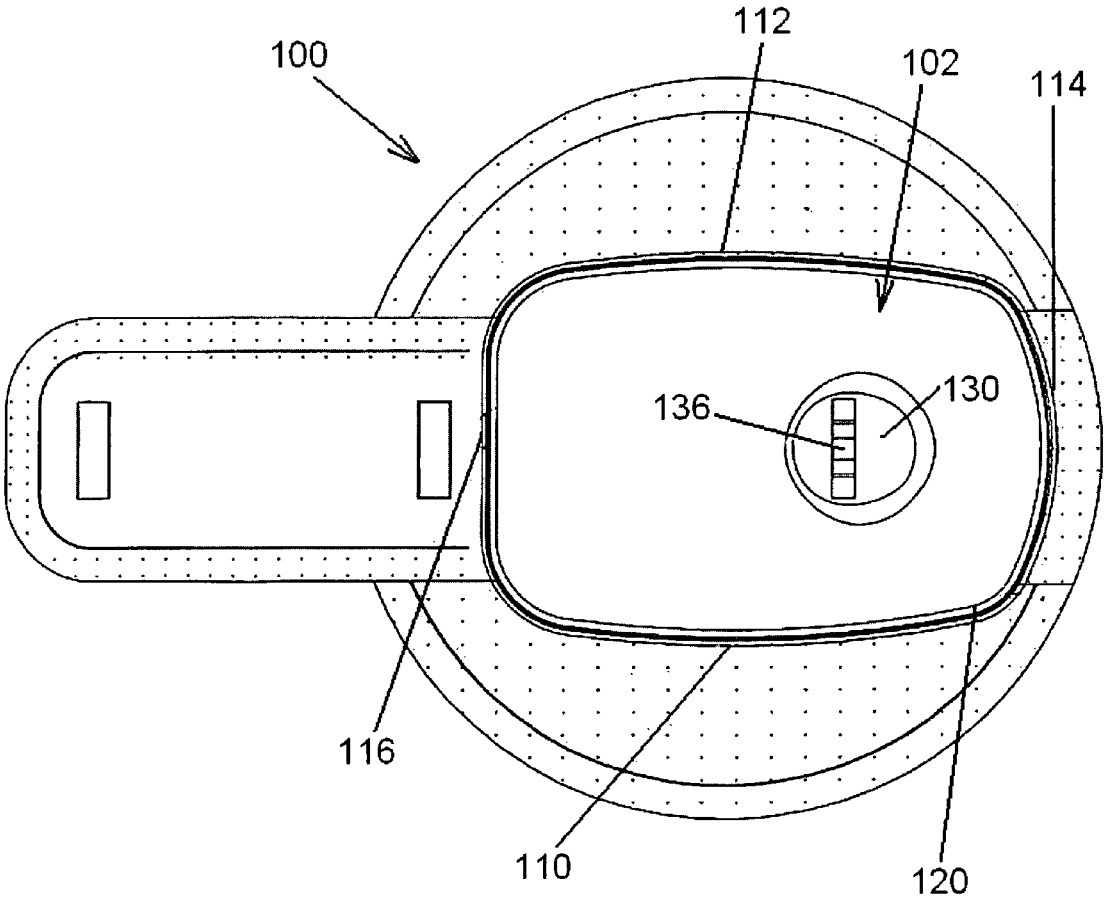
FIG. 12 is a top plan view of the invertible mound assembly of FIG. 11, showing the configuration of the raised surface of the mound section and also its relationship to the surrounding replaceable surface sections in greater detail.
Figure 13:
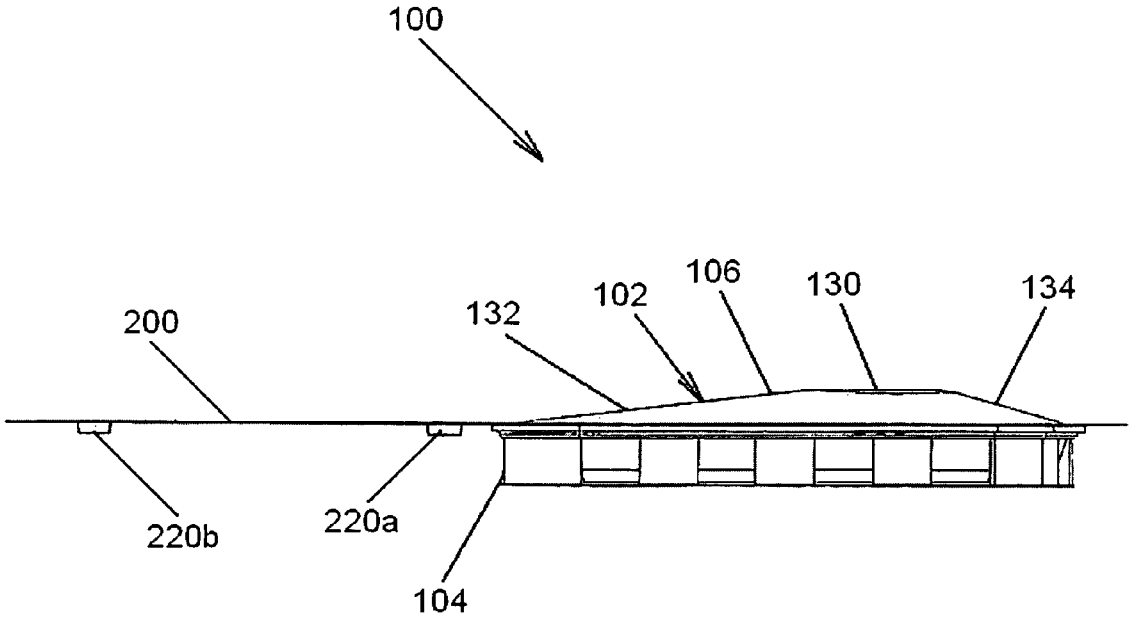
FIG. 13 is a side elevational view of the invertible mound assembly of FIG. 11, showing the recessed base section that supports and positions the mound section at the surface of the surrounding field.
Figure 14:
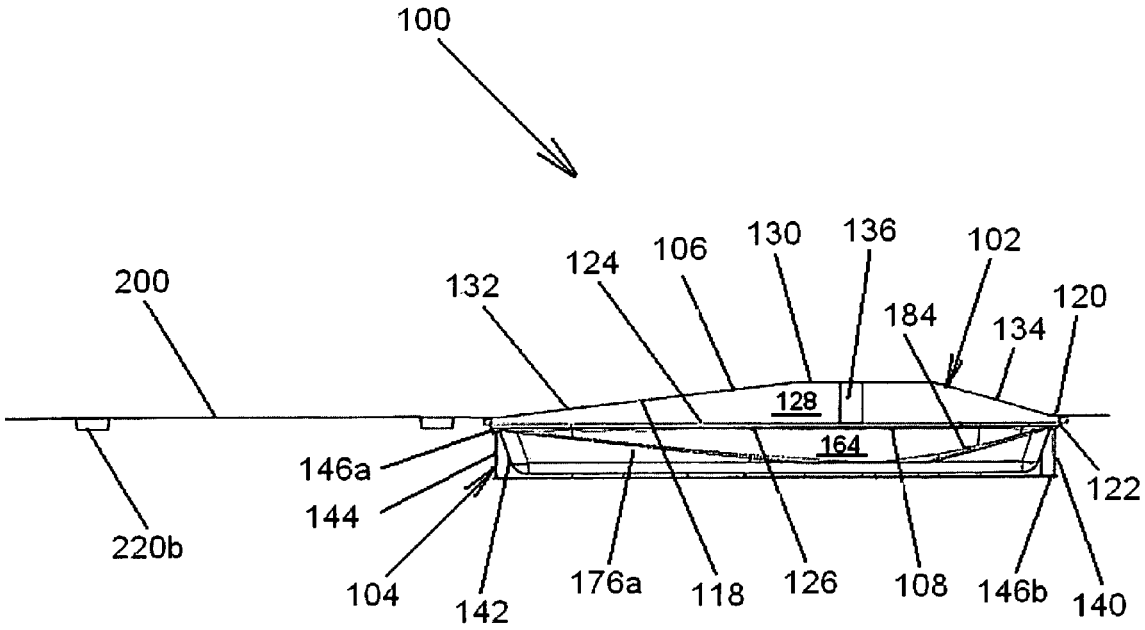
FIG. 14 is a side cross-sectional view of the invertible mound assembly of FIG. 1, showing the relationship between the mound section and a tub-shaped liner of the base section and the manner in which the latter provides a recess that accommodates the raised portion of the mound section when the mound section is inverted and installed with the flat side thereof level with the surface of the surrounding field.

Similar to the embodiment described above, the assembly 100 shown in FIG. 11 includes an invertible mound section 102 that is supported on a base section 104, the latter being recessed below the level of the surrounding playing surface. As can be seen in FIG. 14, the mound section 102 is also similar in having a flattened, somewhat lenticular-shaped body with the raised mound surface 106 on one side and a generally flat surface 108 on the other. In plan view, however, mound section 102 is somewhat rectangular rather than circular, with long edges 110, 112 on the sides facing towards first and third bases, and a short edge 114 facing towards third base and a second short edge 116 facing towards home plate, the direction towards the latter being indicated by arrow 118 in FIG. 11. As opposed to the circular form described above, the rectangular configuration shown in FIGS. 11-18 provides the mound body with several significant advantages for certain applications, which in addition to better meeting the dimensional requirements of some installations include reduced weight, easier portability, and more compact packaging for transportation or storage; in addition, the relatively shorter lateral dimension renders the mound body somewhat easier to invert, by simply flipping it over about the long axis of the body. By way of example only, and not limitation, suitable dimensions for the rectangular mound body are approximately 104 inches by 75 inches with a 6 inch rise.

Referring again to FIG. 11 and also to FIG. 16, the base section 104 of assembly 100 is correspondingly rectangular in plan view, with an upper opening contoured and dimensioned to receive the raised surface 106 of the mound section when the latter in inverted and set therein, the surrounding lip of the base section contacting a perimeter flange of the mound body and supporting engagement therewith as described in greater detail below.

Figure 11:
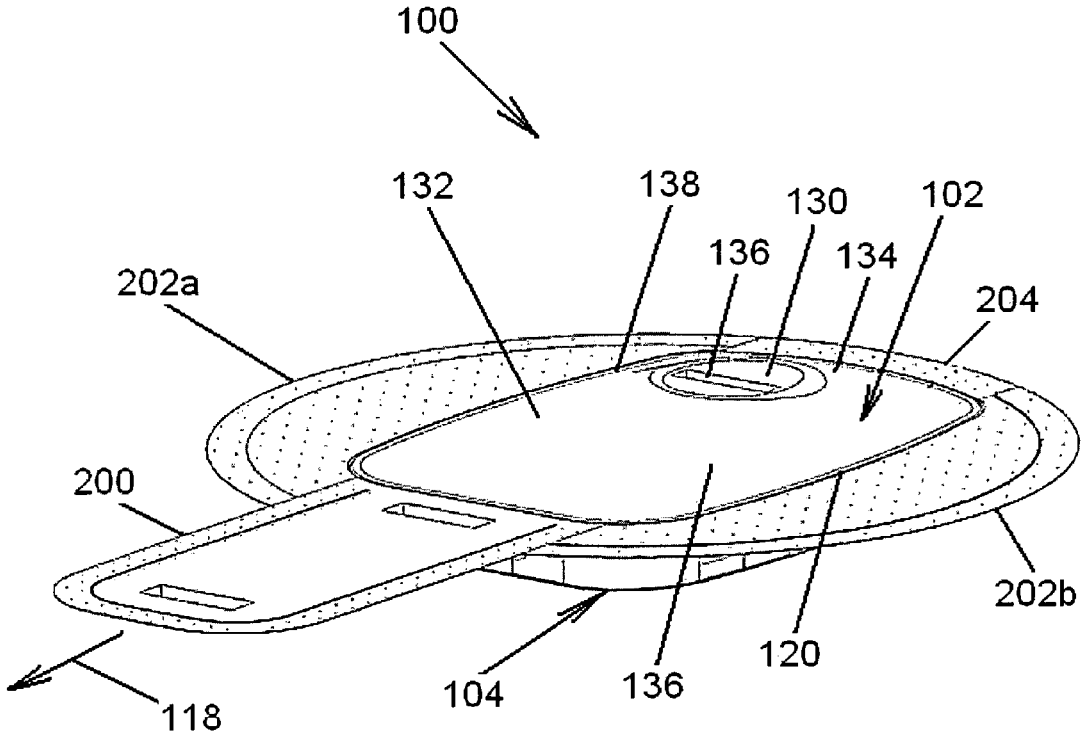
FIG. 11 is a top perspective view of an invertible mound assembly in accordance with another preferred embodiment of the present invention, showing the assembly with the mound section placed on the base section in the raised configuration and with replaceable surface sections installed in high-wear areas about the perimeter of the mound section.

As is also described in greater detail below, the mound and base sections 102, 104 are as shown in FIG. 11 optionally surrounded by an assemblage of tray structures that releaseably retain a surface material so that the latter is readily replaceable when worn, such as synthetic turf material for example.

Referring now to FIGS. 14-21, the structure of the mound section 102 and cooperating base section 104 will be described in greater detail.

As noted above, and as can be seen in the cross-sectional view of FIG. 14, the body of the mound section is roughly lenticular in overall form, with the somewhat dome-shaped raised surface 106 on one side and the flat surface 108 on the other. Similar to the embodiment described above, the upper surface 106 in the illustrated embodiment is preferably formed of a comparatively thin sheet 118 of substantially rigid material, such as molded polymeric plastic, fiber-resin material or sheet metal, for example. About the perimeter of the mound body, the upper surface flattens out to form a substantially horizontal flange surface 120, with a lip 122 depending at the outer edge thereof.

The flat surface 108 of the mound section is in turn suitably formed by a flat panel 124 of material, for example of the type noted above or of plywood or other substantially rigid material, the edge of the panel 124 being set within the depending lip 122 of the upper shell 118 and mounted thereto, e.g., employing a suitable adhesive or fasteners. The outer surface of the planar panel 124 is preferably covered with a material 126 suitable for a pitching area, such as synthetic turf or an artificial track material, for example, and the raised surface 106 may also be provided with such a covering (not shown). The interior volume 128 between the upper and lower panels 118, 126 may be formed with the material that imparts additional rigidity to the mound section and is also preferably light in weight, such as closed cell foam or a honeycomb polymeric material for example.

As was noted above, the invertible mound assembly of the embodiment shown in FIGS. 11-21 is particularly suited to use in installations for a field intended to be alternately configured for use in boys and girls baseball. Therefore, as will be understood by those skilled in the relevant art, the raised surface 106 of the mound body includes a somewhat circular, horizontal platform area 130 at its apex, upon which the pitcher stands when the assembly is configured in accordance with the rules for boys baseball. Also in accordance with the rules for boys play, a comparatively shallowly sloped surface 132 extends from the pitcher's platform 130 downwardly in the direction of home base to the level of the playing field, while a shorter, more steeply sloped surface 134 extends downwardly to the rear in the direction of second base. Surfaces 136, 138 having an intermediate slope extend downwardly towards first and third bases on opposite sides of the pitcher's platform 130. A rectangular cavity 136, aligned transversely to the longitudinal axis of the mound body and towards the front of the pitcher's platform 130 accommodates a block-shaped pitcher's rubber or rubbers (not shown) in an area conventional to aid in establishing the correct distance and making the pitch.

Referring again to FIGS. 14-16 and 19 and 21, it will be seen that the base section 104 is formed in two major subassemblies, namely, a recessed support wall structure 140 and a tub-shaped liner shell 142 that is set within the former.

Figure 15:
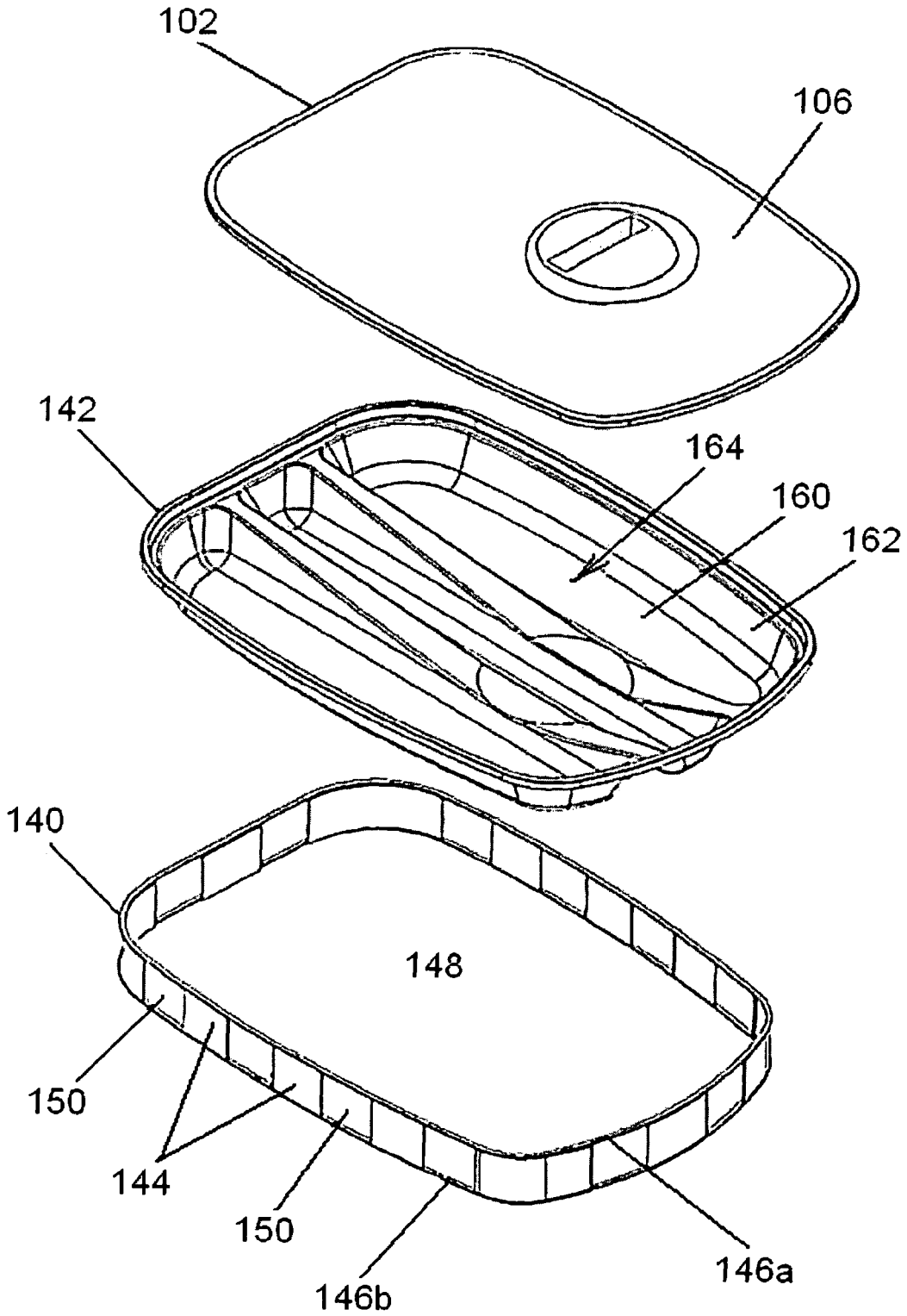
FIG. 15 is an exploded view of the mound section and the tub-shaped liner and support wall of the base section of the invertible mound assembly of FIG. 11, showing the relationship of the components in greater detail.
Figure 16:
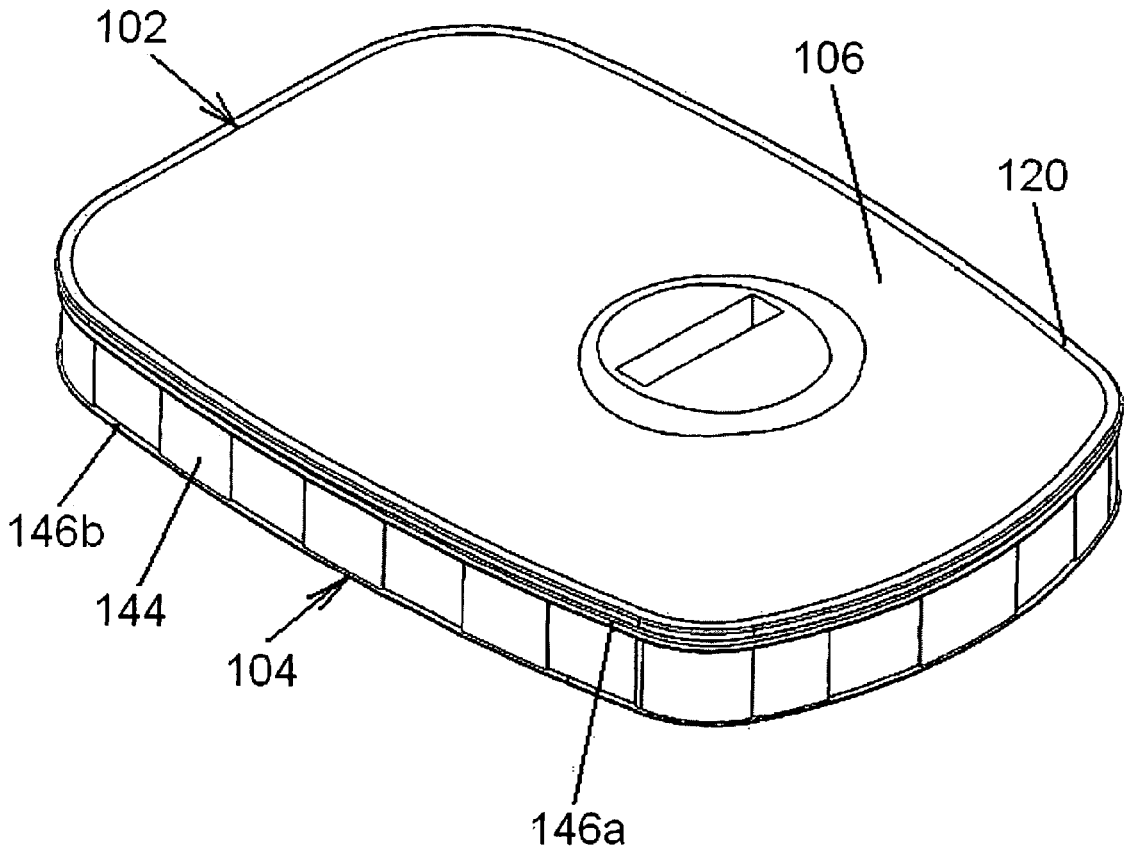
FIG. 16 is a top perspective, assembled view of the mound section and base section components of FIG. 15, with the mound section installed with the raised surface thereof disposed upwardly.
Figure 17:
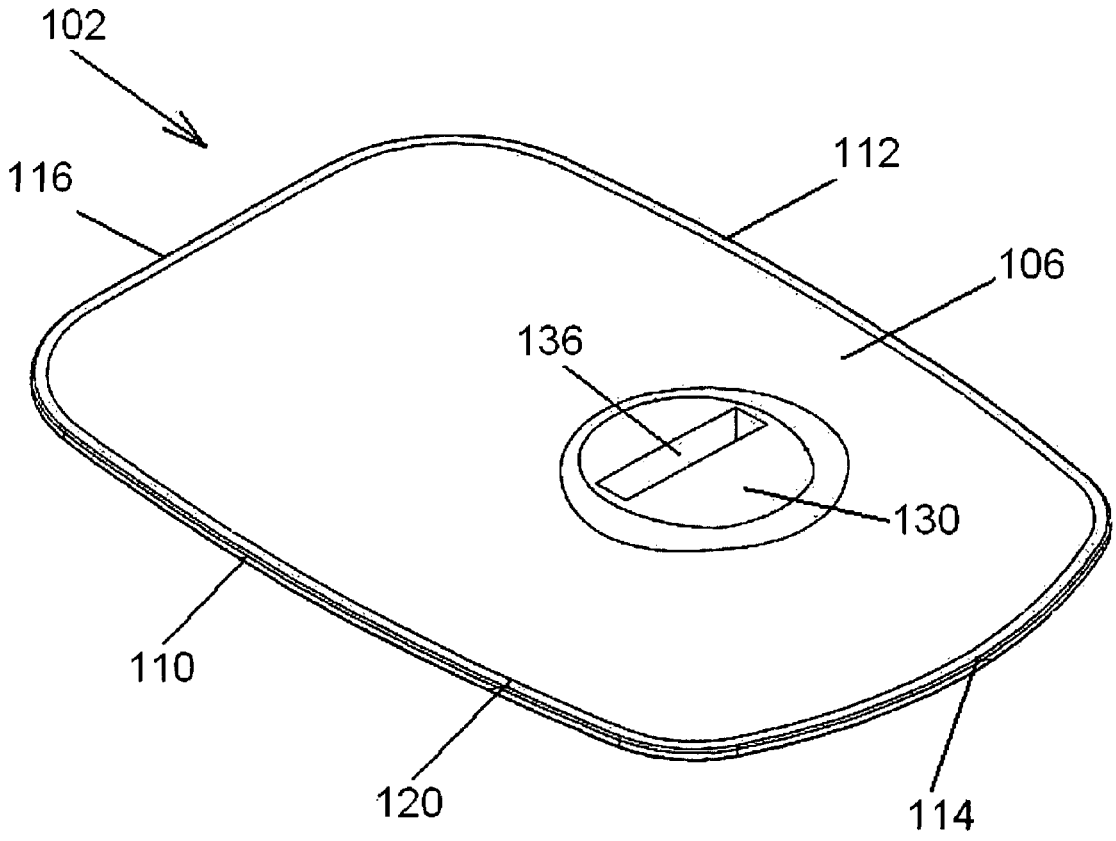
FIG. 17 is a top perspective view of the mound section of the invertible mound assembly of FIG. 11, showing the raised surface thereof in greater detail.
Figure 18:
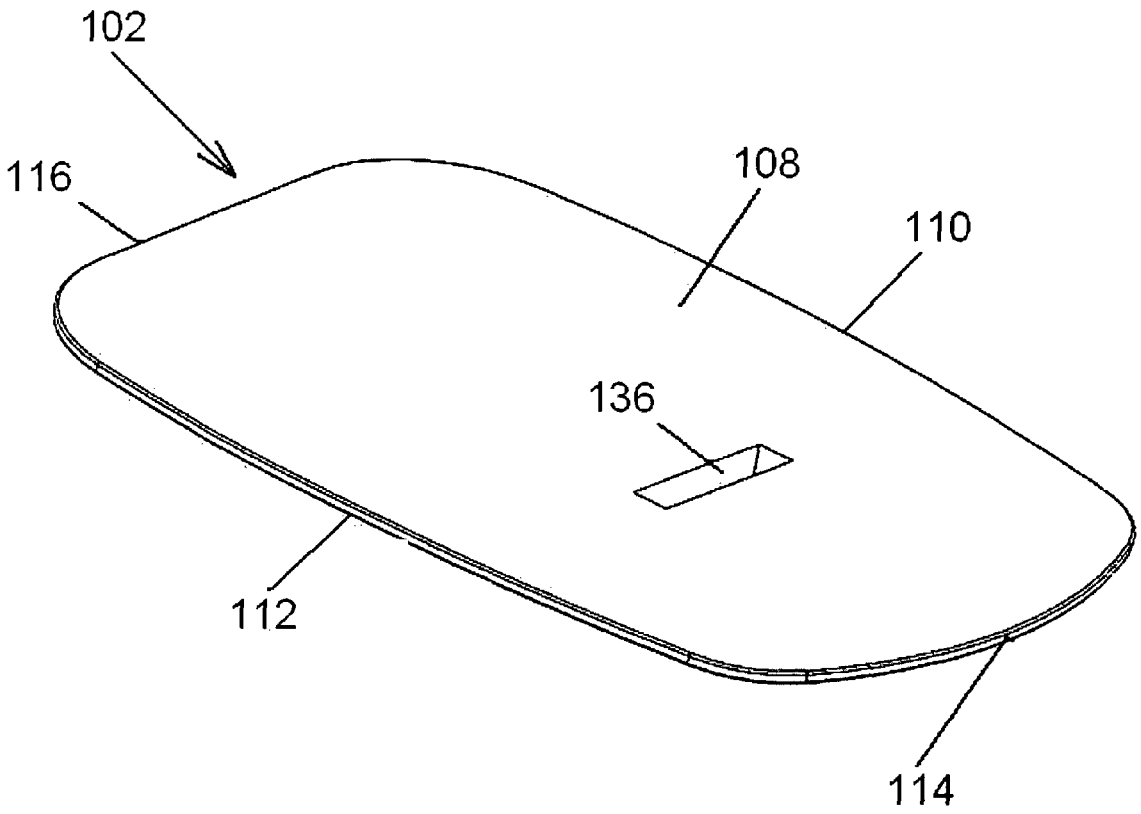
FIG. 18 is a perspective view of the mound section of the invertible mound assembly of FIG. 11, in an inverted orientation from FIG. 17, showing the second, flat surface thereof in greater detail.
Figure 21:
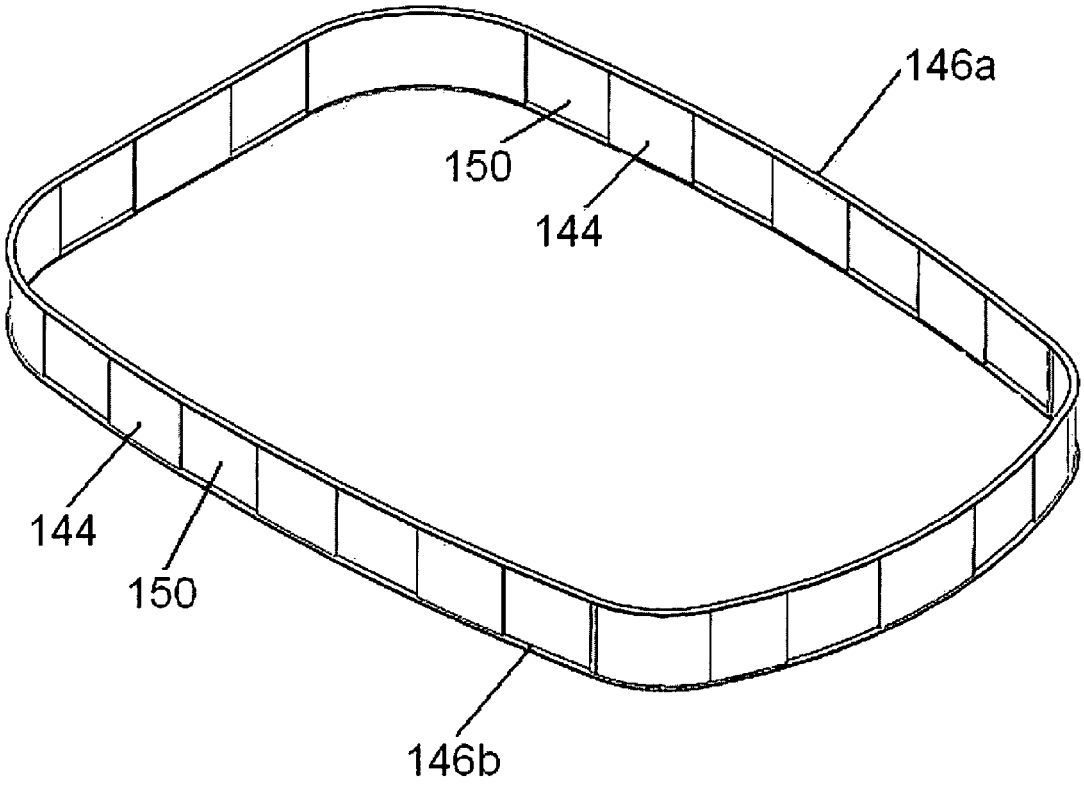
FIG. 21 is a perspective view of the perimeter support wall of the base section of the invertible mound assembly of FIG. 11, showing the structure of the support wall in greater detail.

As can be seen in FIGS. 15-16 and 21, the support wall 140 of the illustrated embodiment is constructed of a series of spaced apart vertical panels 144 set between upper and lower load-bearing rim pieces 146*a*, 146*b*, the latter following the rectangular shaped perimeter of the tub-like shaped shell 142 and overlying mound section 102, such that the wall structure forms a structural ring about an opening 148 that is shaped to receive the tub-shaped shell. The wall segments 144 are in turn dimensioned vertically such that the height of the opening 148 is sufficient to accommodate the height of the tub-shaped shell when the latter is placed upon the upper rim piece 146*a*, as can be seen in FIGS. 13-14. The weight of the shell and mound section are thus borne on the upper rim member 146*a* of the wall structure, with the loads being transferred vertically in compression by the panel members 144 to the lower rim member 146*b*, with the latter in turn being supported by the ground or other substrate. Similar to the embodiment described above, the segmented wall construction, employing spaced apart vertical panel segments 144, provides a rigid yet lightweight structure combined with the opportunity for access/storage through the openings 150 between the panels, however, it will be understood that a continuous wall or other support structure may be employed; furthermore, in some instances the lower wall structure may be more or less dispensed with in favor of a suitably configured excavation, or other form of recess.

As can be seen with further reference to FIG. 15, shell 142 includes a generally horizontal floor 160 surrounded by an upwardly extending wall 162, that together define the open, tub-shaped interior 164. As can better be seen in FIGS. 19-20, a horizontal, outwardly extending shelf 166 is set in wall 162 about the perimeter of the tub opening, with a narrower rim wall 168 extending upwardly therefrom to a second outwardly extending, generally horizontal shelf or shoulder 170 about the upper lip of the shell. Outwardly from horizontal top wall 170 the edge of the shell is down-turned to form a depending lip or flange 172, that in combination with the outside surface of the vertical rim wall 168 defines a downwardly facing channel 174 about the perimeter of the shell.

Figure 19:
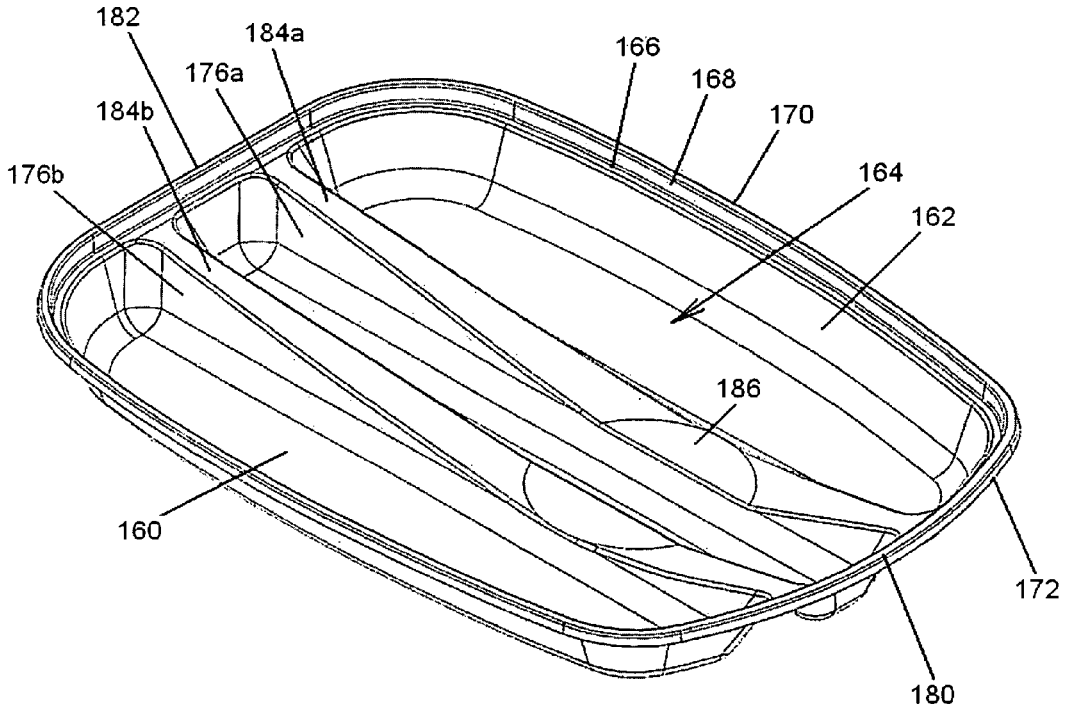
FIG. 19 is a top perspective view of the tub-shaped liner shell of the base section of the invertible mound assembly of FIG. 11, showing the inside surfaces and structure thereof in greater detail.
Figure 20:
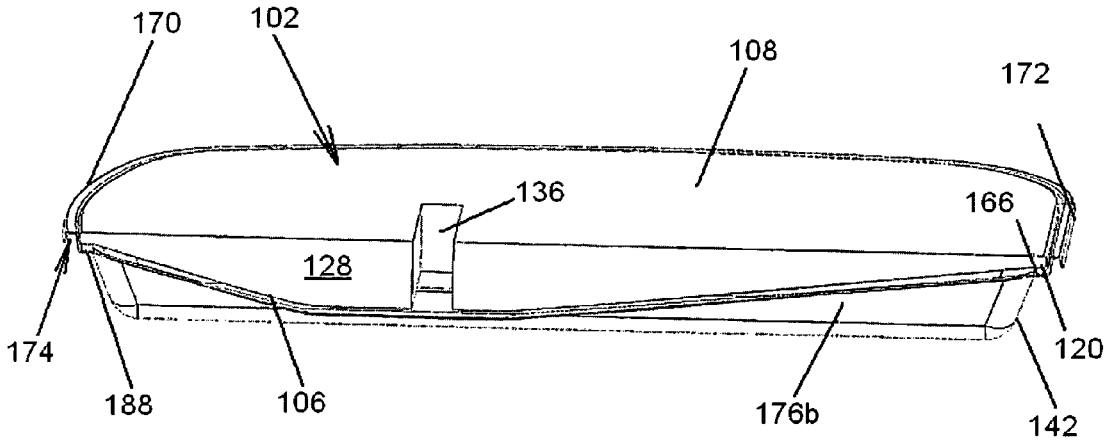
FIG. 20 is a perspective, cross-sectional view of the mound section and the tub-shaped liner shell of the base section of the invertible mound assembly of FIG. 11, showing the manner in which the interior surfaces and structure of the liner shell cooperate with the raised surface of the mound section when the latter is inverted and installed in the base section with the flat surface of the mound section disposed upwardly.

As can be seen with further reference to FIG. 19, first and second upwardly projecting ribs 176*a-b* are formed in the interior 164 of the tub-shaped shell 142. The ribs extend from one short edge 180 of the shell to the other short edge 182, generally parallel to the long axis of the shell, and include relatively broad upper surfaces 184*a*, 184*b* that slope downwardly from the ends 180, 182 to a depressed area 186 that is located towards the middle and proximate the level of the floor 160 of the shell. The slope, contour and location of the surfaces 184*a-b*, and of area 186, correspond generally to the corresponding areas of the raised surface 106 of the mound when the latter is inverted and disposed downwardly within the interior 164 of the shell. The ribs impart rigidity and structural stability to the tub-shaped shell, and may in some installations also provide support under the raised surface of the mound section when the latter is installed with the flat surface disposed upwardly as seen in FIG. 20; in the latter instance, the top surfaces 184*a-b* of the ribs may be provided with strips or layers of reinforcing and/or wear resistant material, such as wear resistant plastic, metal or wood for example. The shell 142 is preferably molded as a single unit of a durable relatively thin rigid or semi-rigid material, such as molded plastic, fiber-resin composite or metal, for example.

As can be seen with further reference to FIG. 20, the horizontal shelf 166 on the upper inside of the tub-shaped shell 142 corresponds in shape generally to the perimeter flange 120 of the body of the mound section, so as to provide support for the latter when installed with the raised surface of the mound section disposed downwardly. Similarly, the corresponding edge area of the flat surface of the mound section rests atop shelf 166 when disposed downwardly, as shown in FIG. 14. The outside/lower surface 188 of shelf 166 in turn rests atop the upper rim piece 146*a* of the underlying wall structure 140. Therefore, in either orientation, the weight of the mound section and the pitcher or other person or persons standing thereon is transferred in a vertical direction to the rim piece 146*a* and vertical wall sections 144, and from there to the lower rim member 146*b* and the substrate on which the latter is supported. Movement of the mound section and the horizontal plane is prevented the vertical rim wall 168 of shell 142, thus keeping the mound section firmly in place during use. Outward of wall 168 the horizontal upper lip surface 170 may be set just slightly below the level of the rim of the mound section in order to accommodate the thickness of a surface covering material installed over the former, so that the surfaces about the mound section are completely flush and therefore free of tripping hazards.

FIGS. 22A-22F illustrate sequentially the process of changing the orientation of the mound section in the installation, between having the raised and flat surfaces disposed upwardly.

Figure 22A:
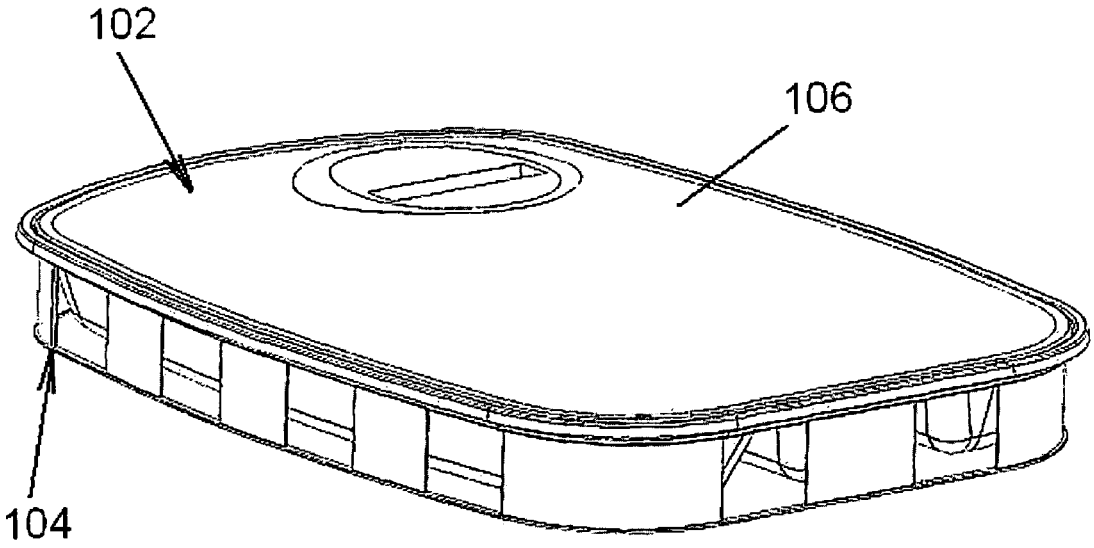
FIGS. 22A-22F are sequential perspective views of the base section and the mound section of the invertible mound assembly of FIG. 11, illustrating the manner in which the mound section can be raised from the base section, flipped and then reinstalled on the base section, so as to alternately dispose either the raised surface or the flat surface of the mound section upwardly as desired.
Figure 22B:
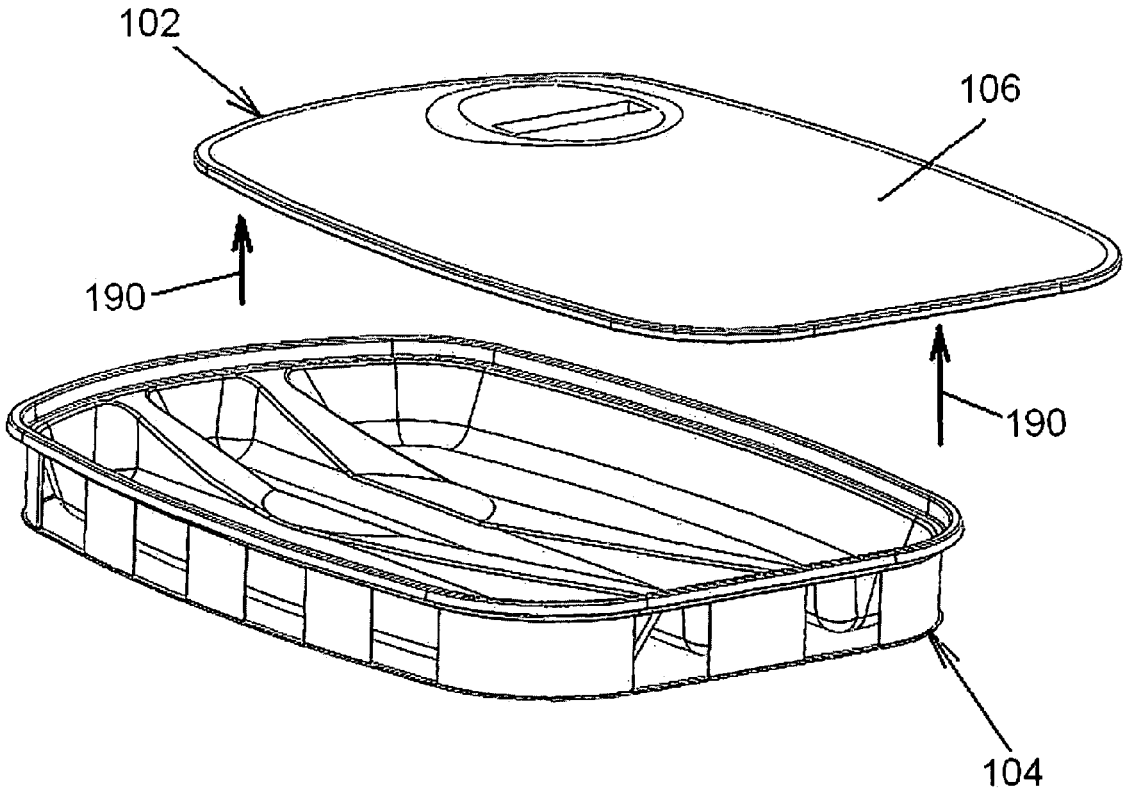
Figure 22C:
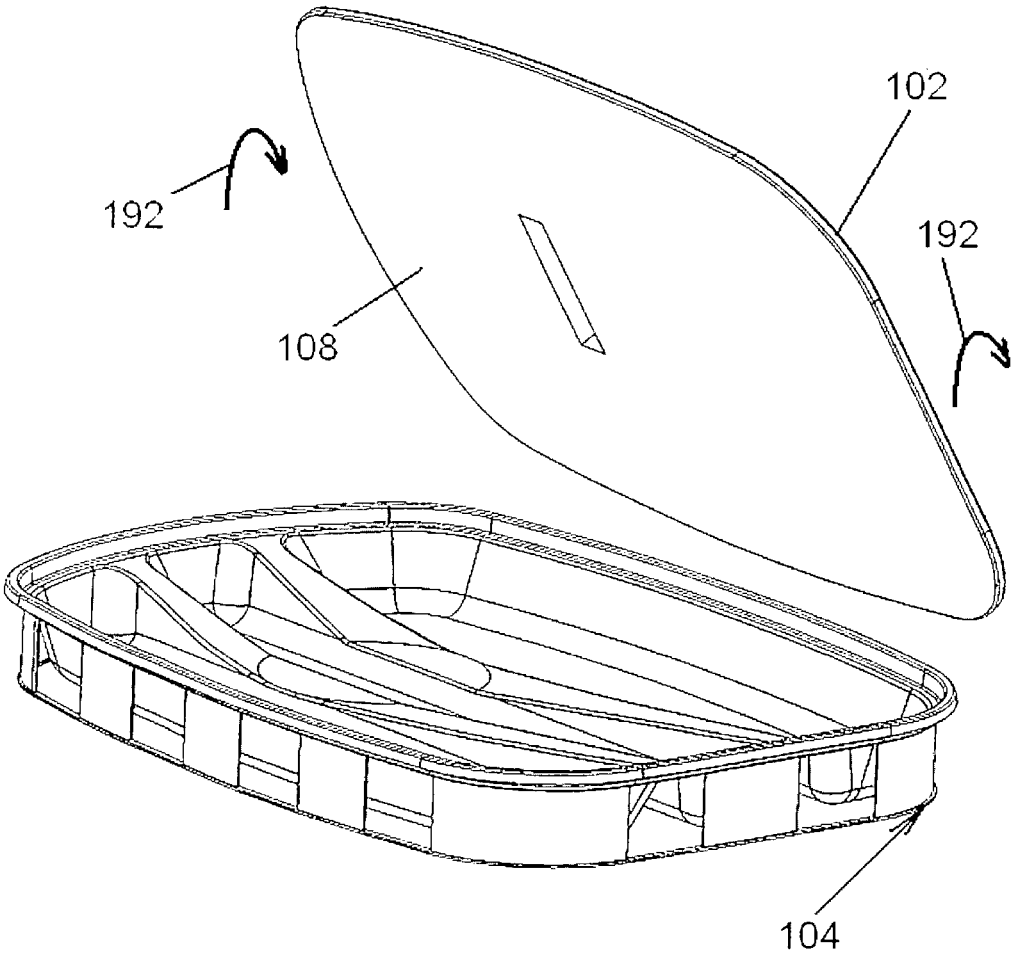
Figure 22D:
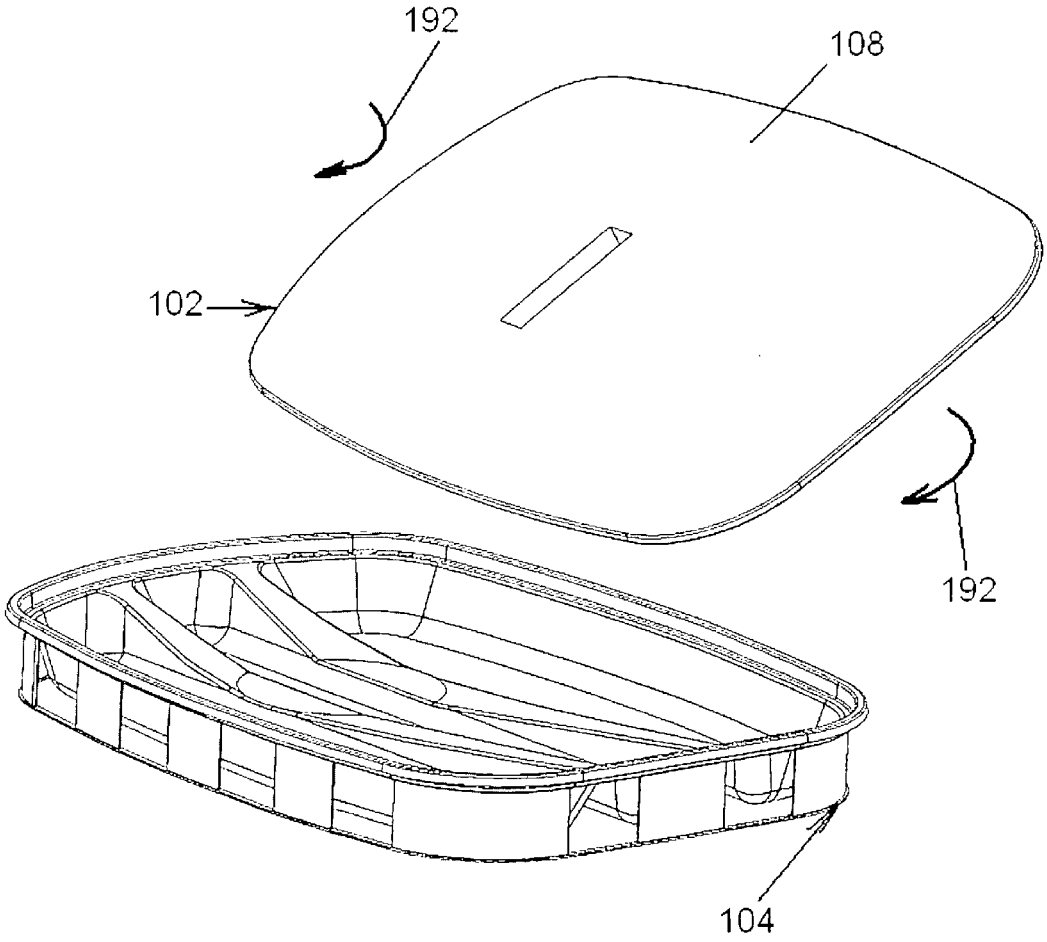
Figure 22E:
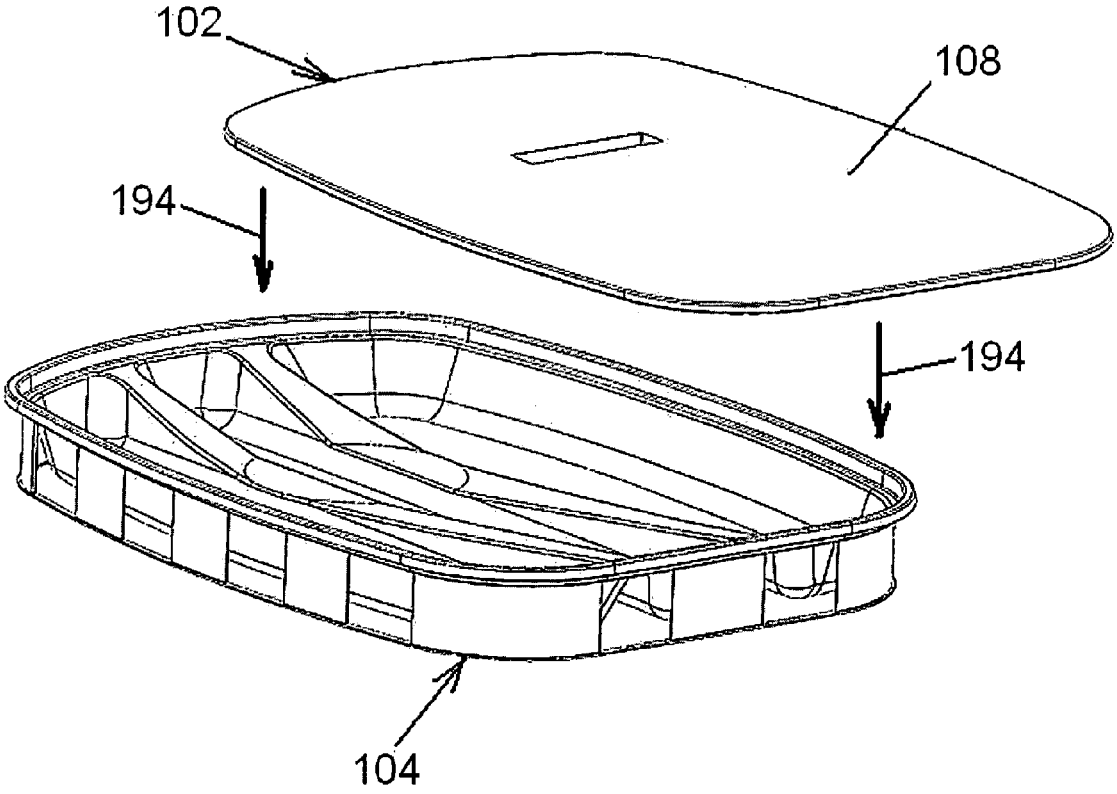
Figure 22F:
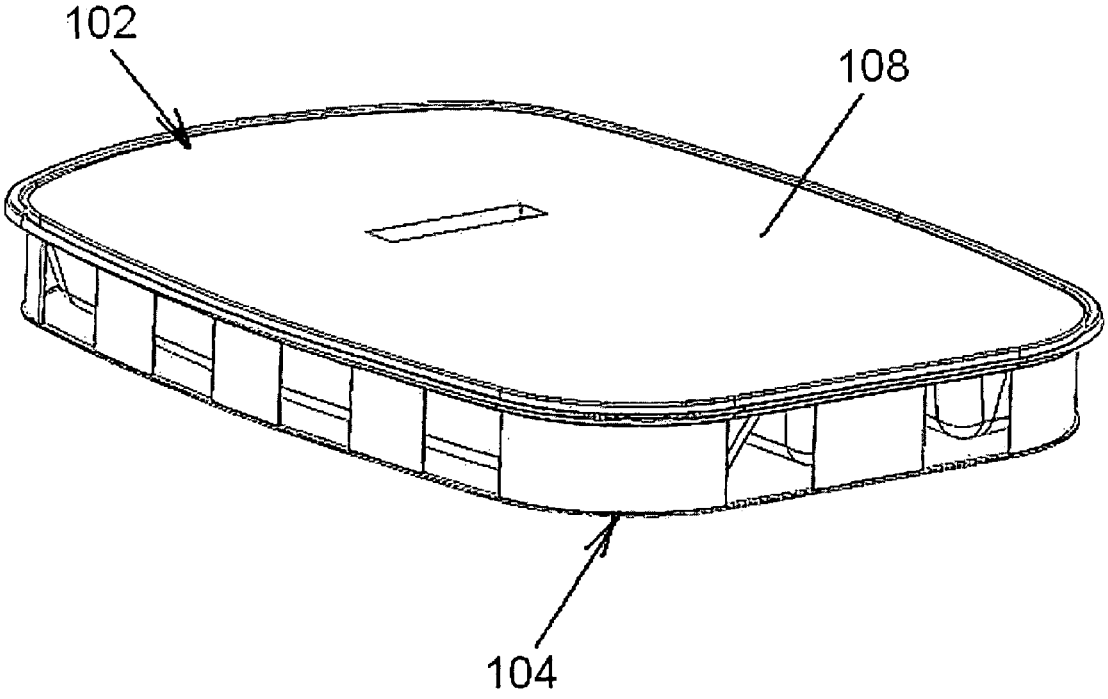
Figure 23:
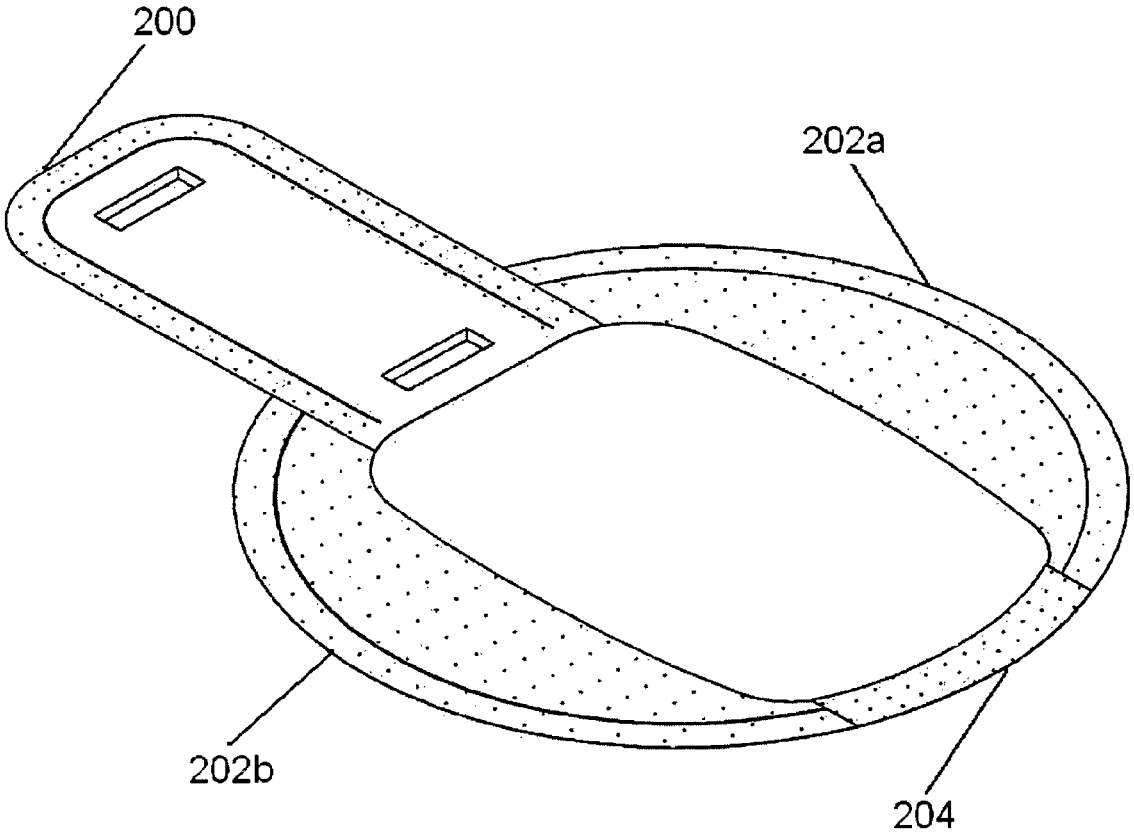
FIG. 23 is a top perspective view of the replaceable surface components of the invertible mound assembly of FIG. 11, showing the positioning thereof in the high wear areas around the perimeter of the mound section.

In the illustrated example, FIG. 22A shows the assembly in an initial condition in which the body of the mound section 102 is installed with the raised mound surface 106 disposed upwardly, for example for use in accordance with the rules applicable to boys baseball. To change the orientation the mound section is lifted away from the base section 104, as indicated by arrows 190 in FIG. 22B; in the illustrated embodiment the lifting and subsequent steps can be performed manually, however it will be understood that various implements and mechanisms may be employed as well. After being lifted off the base section, the mound section is flipped over, suitably by rotating it about the long axis of the mound body as indicated by arrows 192 in FIGS. 22C-22D, bringing the flat surface 108 of the mound body upward. With the flat surface 106 more or less horizontal, the mound section 102 is then lowered back into the opening formed by the shell 142 of the base section, in the direction indicated by arrows 194 in FIG. 22E. As this is done, the edge of the mound section is aligned with the perimeter of the opening of the shell, and then the mound section is dropped into place so that it rests atop the shoulder 166 of the base section in the manner described above, with flat surface 106 disposed upwardly, e.g., for use in accordance with the rules applicable to girls baseball or use of the playing field for other purposes, such as soccer, lacrosse, football and so on. When desired, the mound section can be brought back to the orientation having the raised surface disposed upwardly by reversing the above steps.

As was noted above, the installation of the assembly shown in FIG. 11 includes an optional assemblage of replaceable turf sections located in predetermined high-wear areas about the perimeter of the mound assembly. As can be seen in FIG. 11 and also FIGS. 24-25, the replaceable turf sections include an elongate, somewhat tongue-shaped home base section 200 that extends forwardly from the mound area, first and third base sections 202*a-b* that extend to the sides, and a third base section 204 at the rear.

Figure 24:
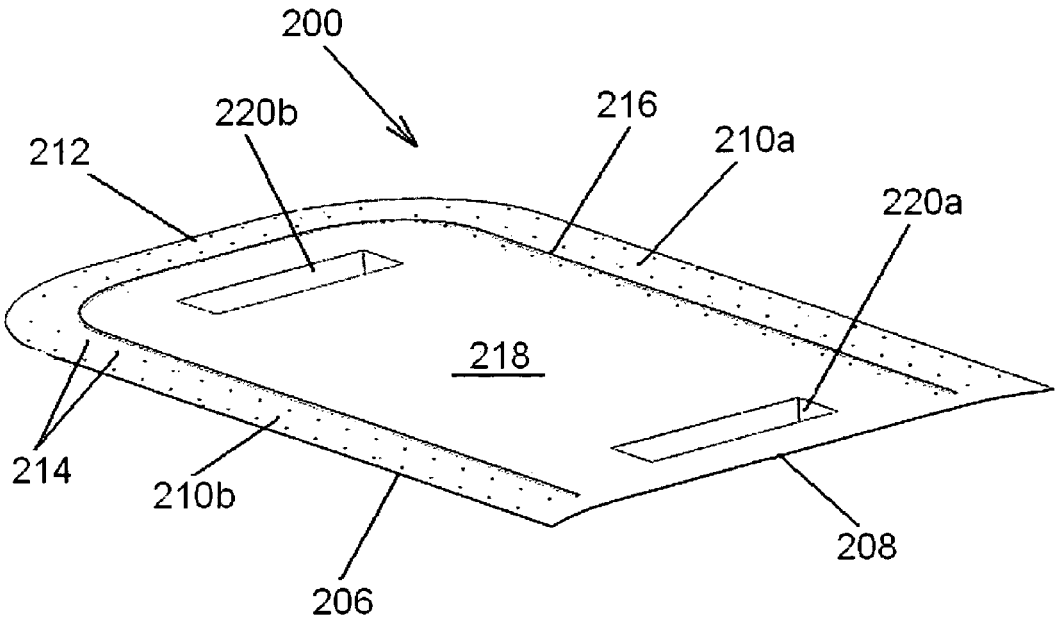
FIG. 24 is an enlarged top perspective view of the replaceable surface section positioned in the high wear area in front of the mound section, on the side towards home base, showing the configuration thereof in greater detail and also the positioning of recesses formed to retain pitching rubbers therein.

As can be seen in greater detail in FIG. 24, the replaceable turf section 200 that extends towards first base includes an elongate panel 206 having a base edge 208 that closely follows the corresponding edge of the base section of the mound assembly, and lateral and distal border portions 210*a-b*, 212 that extend beneath the artificial turf or other surface material of the surrounding field and include perforations 214 or fasteners securing the surface material to the plate member. A shallow raised rib 216 spaced inwardly and generally following the lateral and distal edges on the plate defines a central tray area 218, bordered on three sides by the edge flanges 210*a-b* and 212. In the illustrated embodiment, first and second rectangular, transversely-extending recesses 220*a-b* are formed at spaced apart locations along the longitudinal centerline of the panel 206, for installation of pitching rubbers (not shown) at predetermined locations, e.g., at the distances specified under the different rules applicable to boys and girls baseball.

In use, a piece of replaceable surface material is installed in the tray area 218 in a manner that allows it to be removed and replaced when worn, for example, using an adhesive or hook-and-loop fastening material. The area in front of the mound is a high wear area, over which the pitcher travels repeatedly towards and away from home base. Thus, when the surface material in this area becomes worn, pulled up and replaced with a relatively small piece of fresh material cut to have the proper shape, rather than having to cut out and replace a piece of the surface material of the main field itself.

Figure 25:
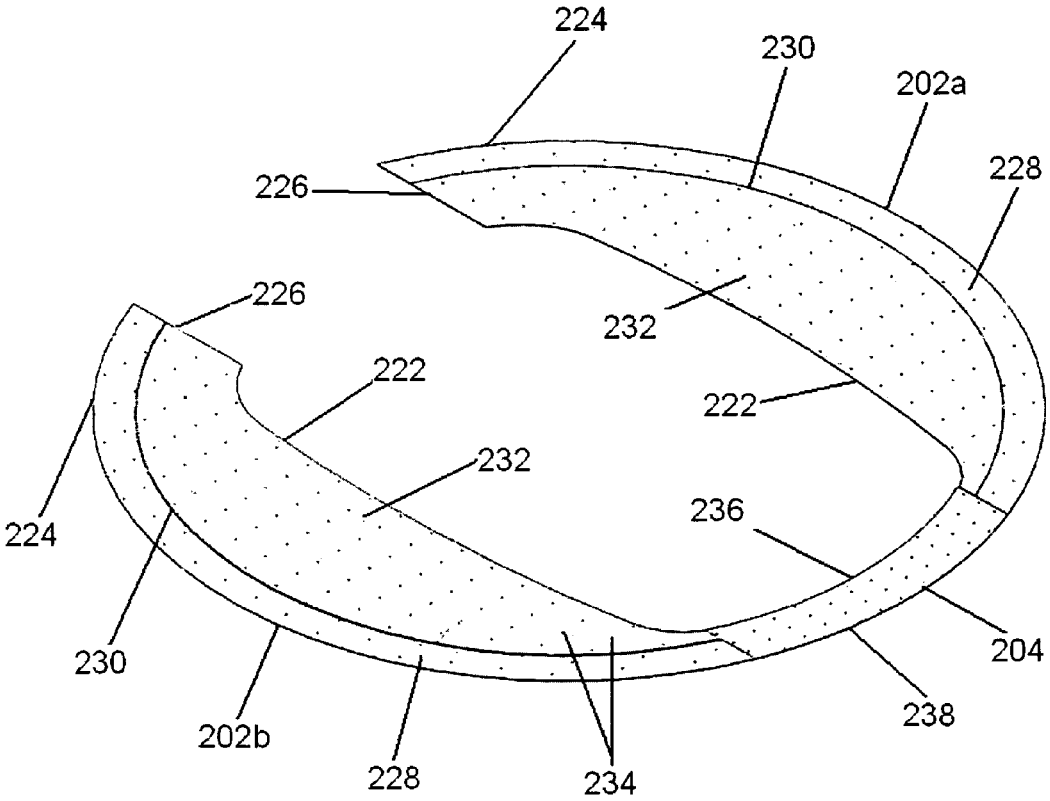
FIG. 25 is a top perspective view of the replaceable surface sections on the first base, third base and second base sides of the mound section in FIG. 11, showing the configuration and locations thereof in greater detail.

As can be seen in FIG. 25, the third and first base sections 202*a-b* are each somewhat semilunar or apron-like in shape, with inner edges 222 that follow the long lateral sides of the generally rectangular mound section, and semi-circular outer edges 224 that combine to form a circular outline about the mound section. At their forward ends, the sections terminate in generally straight edges that border the longitudinal edges of the forwardly projecting first base section, as shown in FIGS. 11-12.

Similar to the tongue-shaped first base section, the curved first and third base sections include flange-shaped border portions 228 that fit under the surface material of the surrounding field, with a raised rib 230 separating the border portions from tray areas 232 that hold replaceable pieces of surface material in high wear areas adjacent the mound. Given that these areas are subject to a somewhat lesser degree of wear than the tongue-shaped first base section at the front, they will generally need replacement less frequently and therefore may advantageously be secured in a somewhat longer-lasting manner, e.g., using perforations 234 or fasteners similar to the border flanges, from which the surface material can be pulled up when needed. The replaceable surface assemblage is completed by the second base section 204, that spans the area between the first and third base sections and includes an inner edge 236 that follows the corresponding edge of the mound section and a curved outer edge 238 that aligns with the edges of the semi-lunar sections to continue the circular outline around the mound area.

It will be understood that the scope of the appended claims should not be limited by particular embodiments set forth herein, but should be construed in a manner consistent with the specification as a whole.

What is claimed is:

1. An invertible mound assembly for a game field having a generally field surface, said mound assembly comprising:

a mound section, comprising a body having a first side with a raised surface and a second side having a substantially flat surface; and a base section that is mountable in an opening in said game field and comprises a support that maintains said mound section alternately in (i) a first orientation in which said first side having said raised surface is disposed upwardly so as to form a mound extending above said flat surface of said game field, and (ii) a second orientation in which said second side having said substantially flat surface is disposed upwardly so as to be substantially flush with said flat surface of said game field.

2. The invertible mound assembly of claim 1, wherein said substantially flat surface of said second side of said body of said mound section comprises:

a surface material that substantially matches a surface material of said flat surface of said game field.

3. The invertible mound assembly of claim 2, wherein said surface materials of said flat surface of said body of said mound section and said flat surface of said game field both comprise artificial turf material.

4. The invertible mound assembly of claim 1, wherein said base section comprises:

an opening that extends below a level of said flat surface of said game field, that receives said raised surface of said body of said mound section when said body of said mound section is supported on said base section with said flat surface thereof disposed upwardly.

5. The invertible mound assembly of claim 4, wherein said body of said mound section comprises:

a generally flattened body having said raised surface and said flat surface formed on opposite sides thereof.

6. The invertible mound assembly of claim 5, wherein said support of said base section comprises:

at least one support member that engages a perimeter of said body of said mound section in said first and second orientations.

7. The invertible mound assembly of claim 6, wherein said at least one support member of said base section comprises:

at least one support member that is set a predetermined depth below said flat surface of said game field, said predetermined depth corresponding to a predetermined thickness of said perimeter of said body of said mound section so that said perimeter of said body of said mound section rests substantially flush with said flat surface of said game field in said first and second orientations.

8. The invertible mound assembly of claim 7, wherein said perimeter of said body of said mound section comprises a flattened edge about a perimeter of said raised surface that cooperates with said flat surface on said second side of said body of said mound section to define a load bearing flange about said body of said mound section, said load bearing flange having said thickness corresponding to said predetermined depth at which said support is set below said flat surface of said game field.

9. The invertible mound assembly of claim 8, wherein said at least one support member of said base section comprises:

a substantially flat support surface that engages said flange about said body of said mound section in vertical load bearing engagement therewith.

10. The invertible mound assembly of claim 5, wherein said body of said mound section comprises:

a domed shell member that forms said raised surface having an outer surface and a hollow inner surface; and a substantially flat plate member that is mounted across said inside inner surface of said shell member to form said flat surface of said body of said mound section.

11. The invertible mound assembly of claim 10, wherein said shell member comprises:

a substantially unitary shell member formed of a molded polymeric material.

12. The invertible mound assembly of claim 11, further comprising:

a load bearing material contained within said hollow inner surface so as to provide support beneath said raised surface formed by said shell.

13. The invertible mound assembly of claim 6, wherein said support member comprises:

a generally horizontal support member that extends over at least a portion of said opening that receives said body of said mound section.

14. The invertible mound assembly of claim 13, wherein said base section further comprises:

a second support member that engages an underlying substrate of said game field.

15. The invertible mound assembly of claim 14, wherein said base section further comprises:

a wall structure that transmits loads vertically from a structural member that engages said body of said mound structure to said second support member that engages said underlying substrate of said game field.

16. The invertible mound assembly of claim 15, wherein said wall structure of said base section comprises:

a plurality of vertical wall sections mounted at spaced apart locations so as to form a plurality of access gaps intermediate said wall sections.

17. The invertible mound assembly of claim 6, wherein said base section further comprises:

a downwardly extending shell mounted on said support member of said base section that forms a recess having an interior that receives said base surface of said body of said mound section when disposed downwardly in said base section.

18. The invertible mound assembly of claim 17, wherein said downwardly extending shell comprises:

a substantially horizontal shelf portion about at least a portion of a perimeter of said shell that supports said body of said mound section on said support member of said base section.

19. The invertible mound assembly of claim 18, wherein said shell of said base section further comprises:

an upstanding rib portion located outwardly of said shelf portion that constrains said body of said mound section against lateral movement on said base section.

20. A method for selectively configuring a game field between a flat field configuration and a raised mound configuration, said method comprising the steps of:

forming a downward recess in a selected location of said game field;

forming a mound body having a raised surface on a first side and a flat surface on a second side;

placing said mound body in said recess with said raised surface disposed downwardly and said flat surface disposed upwardly so as to be substantially flush with said game field; and inverting said mound body in said recess with said flat surface disposed downwardly and said raised surface disposed upwardly so as to form a mound extending above said game field.

* * * * *